US011189221B2

(12) United States Patent
Ouyang et al.

(10) Patent No.: US 11,189,221 B2
(45) Date of Patent: Nov. 30, 2021

(54) DISPLAY BRIGHTNESS COMPENSATION METHOD AND SYSTEM

(71) Applicant: Xiamen Tianma Micro-Electronics Co., Ltd., Xiamen (CN)

(72) Inventors: Junting Ouyang, Shanghai (CN); Yang Yang, Shanghai (CN); Bojia Lv, Shanghai (CN); Kerui Xi, Shanghai (CN); Boquan Lin, Shanghai (CN); Xiangzi Kong, Shanghai (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 16 days.

(21) Appl. No.: 16/835,313

(22) Filed: Mar. 31, 2020

(65) Prior Publication Data

US 2020/0226976 A1 Jul. 16, 2020

(30) Foreign Application Priority Data

Dec. 31, 2019 (CN) ..... 201911415031.2

(51) Int. Cl.
*G09G 3/30* (2006.01)
*G09G 3/3208* (2016.01)

(52) U.S. Cl.
CPC ..... *G09G 3/3208* (2013.01); *G09G 2320/048* (2013.01); *G09G 2340/08* (2013.01); *G09G 2360/16* (2013.01)

(58) Field of Classification Search
CPC ..... G09G 2320/0233; G09G 2320/043; G09G 2320/045; G09G 2320/0626; G09G 2340/08; G09G 2360/16
See application file for complete search history.

(56) References Cited

U.S. PATENT DOCUMENTS

2010/0259527 A1* 10/2010 Odawara ..... G09G 3/3233 345/211
2014/0055500 A1* 2/2014 Lai ..... G09G 3/3225 345/690
2015/0379967 A1* 12/2015 Kim ..... G09G 5/18 345/212

FOREIGN PATENT DOCUMENTS

CN 106531069 A 3/2017

* cited by examiner

*Primary Examiner* — Roy P Rabindranath

(74) *Attorney, Agent, or Firm* — Kilpatrick Townsend & Stockton, LLP

(57) ABSTRACT

Provided is a display brightness compensation method including: setting an aging grayscale of a monochrome pixel of each of n test display panels; setting m test grayscales of the monochrome pixel; during a time period, illuminating the aging grayscale of the monochrome pixel, periodically illuminating each test grayscale of the monochrome pixel, and periodically obtaining a test display brightness of the monochrome pixel at the test grayscale at the aging grayscale; calculating a brightness-time characteristic of the monochrome pixel at each of the m test grayscales at the aging grayscale; and compensating an actual display brightness of a monochrome pixel of a target display panel at a current display moment based on the brightness-time characteristic. Both m and n are positive integers greater than or equal to 2. The monochrome pixels of any two test display panels have different aging grayscales.

15 Claims, 12 Drawing Sheets

--Prior Art--

DISPLAY BRIGHTNESS COMPENSATION METHOD AND SYSTEM

CROSS-REFERENCE TO RELATED APPLICATIONS

The present application claims the benefit of priority to Chinese Patent Application No. 201911415031.2, filed on Dec. 31, 2019, the content of which is incorporated herein by reference in its entirety.

FIELD

The present disclosure relates to the field of display technologies, and in particular, to a display brightness compensation method and a display brightness compensation system.

BACKGROUND

In the field of display technologies, an organic light-emitting display panel (OLED) has been widely recognized as a third-generation display technology after a liquid crystal display panel due to its advantages such as lightness, active luminescence, fast response, wide viewing angles, rich colors, high brightnesses, low power consumption, and high/low temperature resistance.

FIG. 1 is a schematic diagram of brightness-time characteristics of a display panel in the related art.

As shown in FIG. 1, in the related art, a display panel uses an organic light-emitting diode for display. A light-emitting brightness of the organic light-emitting diode in the display panel attenuates over light-emitting time. The display brightness of the display panel decreases over display time. The display panel has inconsistent display brightnesses at different display moments.

SUMMARY

Embodiments of the present disclosure provides a method and a display brightness compensation system.

One embodiment of the present disclosure provides a display brightness compensation method, which includes: setting an aging grayscale of a monochrome pixel of each of n test display panels; setting m test grayscales of the monochrome pixel of each of the n test display panels; during a time period, illuminating the aging grayscale of the monochrome pixel of each of then test display panels, periodically illuminating each test grayscale of the m test grayscales of the monochrome pixel of each of the n test display panels, and periodically obtaining a test display brightness of the monochrome pixel of each of the n test display panels at the test grayscale at the aging grayscale; calculating a brightness-time characteristic of the monochrome pixel of each of the n test display panels at each of the m test grayscales at the aging grayscale; and compensating an actual display brightness of a monochrome pixel of a target display panel at a current display moment based on the brightness-time characteristic. Both m and n are positive integers greater than or equal to 2, and the monochrome pixels of any two of the n test display panels have different aging grayscales.

Another embodiment of the present disclosure provides a display brightness compensation system, including: n test display panels; a target display panel; an optical device; and a host computer. Each test display panel of the n test display panels is configured to set an aging grayscale of a monochrome pixel of the test display panel; the host computer is configured to set m test grayscales of the monochrome pixel of each of the n test display panels; each test display panel of the n test display panels is configured to illuminate the aging grayscale of the monochromatic pixel during a time period, and to periodically illuminate each test grayscale of the m test grayscales of the monochrome pixel of each of the n test display panels, and the optical device is configured to periodically obtain a test display brightness of the monochrome pixel of each of the n test display panels at the test grayscale at the aging grayscale; the host computer is configured to calculate a brightness-time characteristic of the monochrome pixel of each of the n test display panels at each of the m test grayscales at the aging grayscale; and the target display panel is configured to compensate an actual display brightness of a monochrome pixel of the target display panel at a current display moment based on the brightness-time characteristic. Both m and n are positive integers greater than or equal to 2, and the monochrome pixels of any two of the n test display panels have different aging grayscales.

In the present disclosure, the display brightness compensation method is configured to compensate the display brightness of the target display panel. First, the brightness-time characteristic of the monochrome pixel of the test display panel on each of the $1^{st}$ to $m^{th}$ test grayscales on each of the $1^{st}$ to $n^{th}$ aging grayscales is obtained. The brightness-time characteristic of the monochrome pixel of the test display panel on each of the $1^{st}$ to $m^{th}$ test grayscales on each of the $1^{st}$ to $n^{th}$ aging grayscales is written into the target display panel. Thus, the target display panel obtains the attenuation amount of the brightness of the monochrome pixel of the target display panel from the initial display moment to the current display moment. The target display panel compensates the attenuation amount of the brightness of the monochrome pixel of the target display panel from the initial display moment to the current display moment. After compensation, the ratio of the actual display brightness of the monochrome pixel of the target display panel at the current display moment to the initial display brightness of the monochrome pixel of the target display panel at the initial display moment is larger than 0.99 and smaller than 1.01. Therefore, the display brightness of the monochrome pixel of the target display panel is the same or tends to be the same at different display moments.

BRIEF DESCRIPTION OF DRAWINGS

Embodiments of the present disclosure are described in the accompanying drawings and are briefly introduced as follows. It should be noted that the drawings described as follows are merely part of the embodiments of the present disclosure.

DESCRIPTION OF EMBODIMENTS

Embodiments of the present disclosure will be described in detail as follows with reference to the accompanying drawings.

It should be noted that, the described embodiments are merely exemplary embodiments of the present disclosure, which shall not be interpreted as providing limitations to the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

It should be understood that the term "and/or" used herein is merely an association relationship describing associated objects, indicating that there may be three relationships, for example, A and/or B may indicate that three cases, i.e., A existing individually, A and B existing simultaneously, B existing individually. In addition, the character "/" herein generally indicates that the related objects before and after the character form an "or" relationship.

It should be understood that although a device may be described using the terms of "first", "second", etc., in the embodiments of the present disclosure, the device will not be limited to these terms. These terms are merely used to distinguish devices from one another. For example, without departing from the scope of the embodiments of the present disclosure, a first device may also be referred to as a second device, and similarly, a second device may also be referred to as a first device.

Embodiments of the present disclosure provide a display brightness compensation method and a display brightness compensation system.

Figure 1:
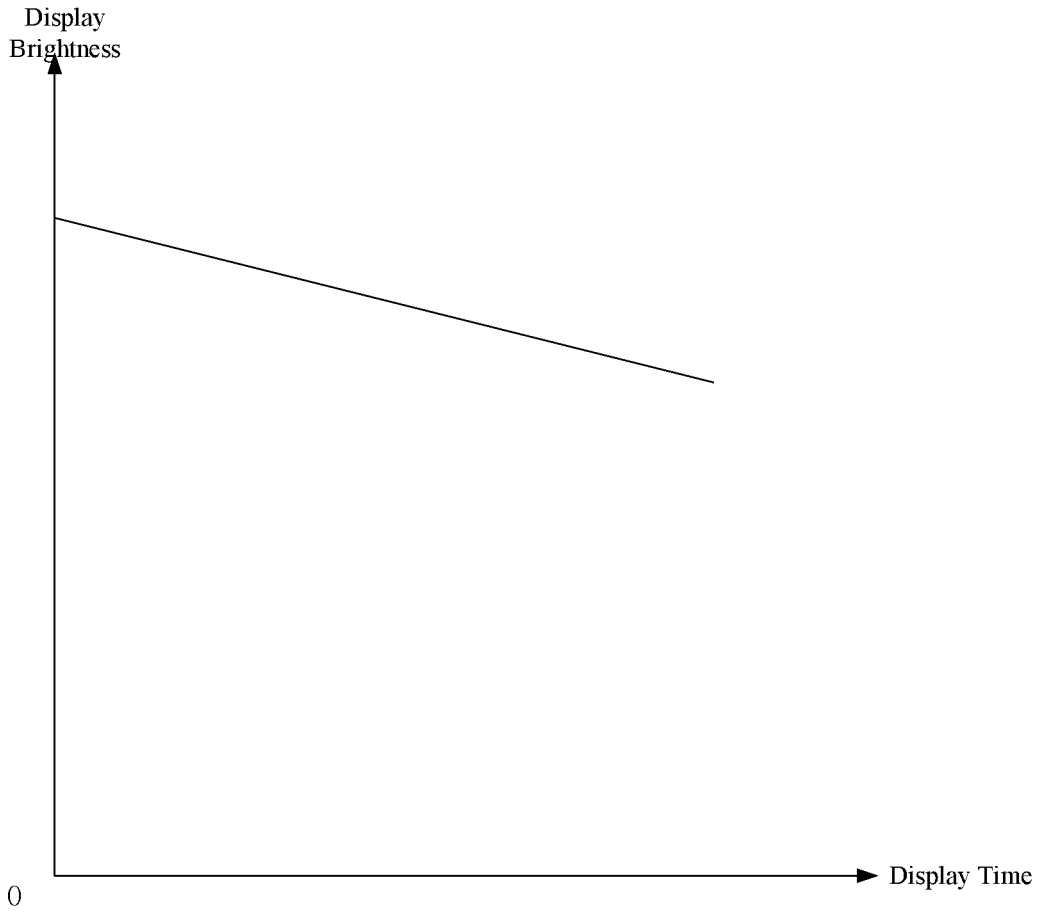
FIG. 1 is a schematic diagram of brightness-time characteristics of a display panel in the related art.
Figure 2:
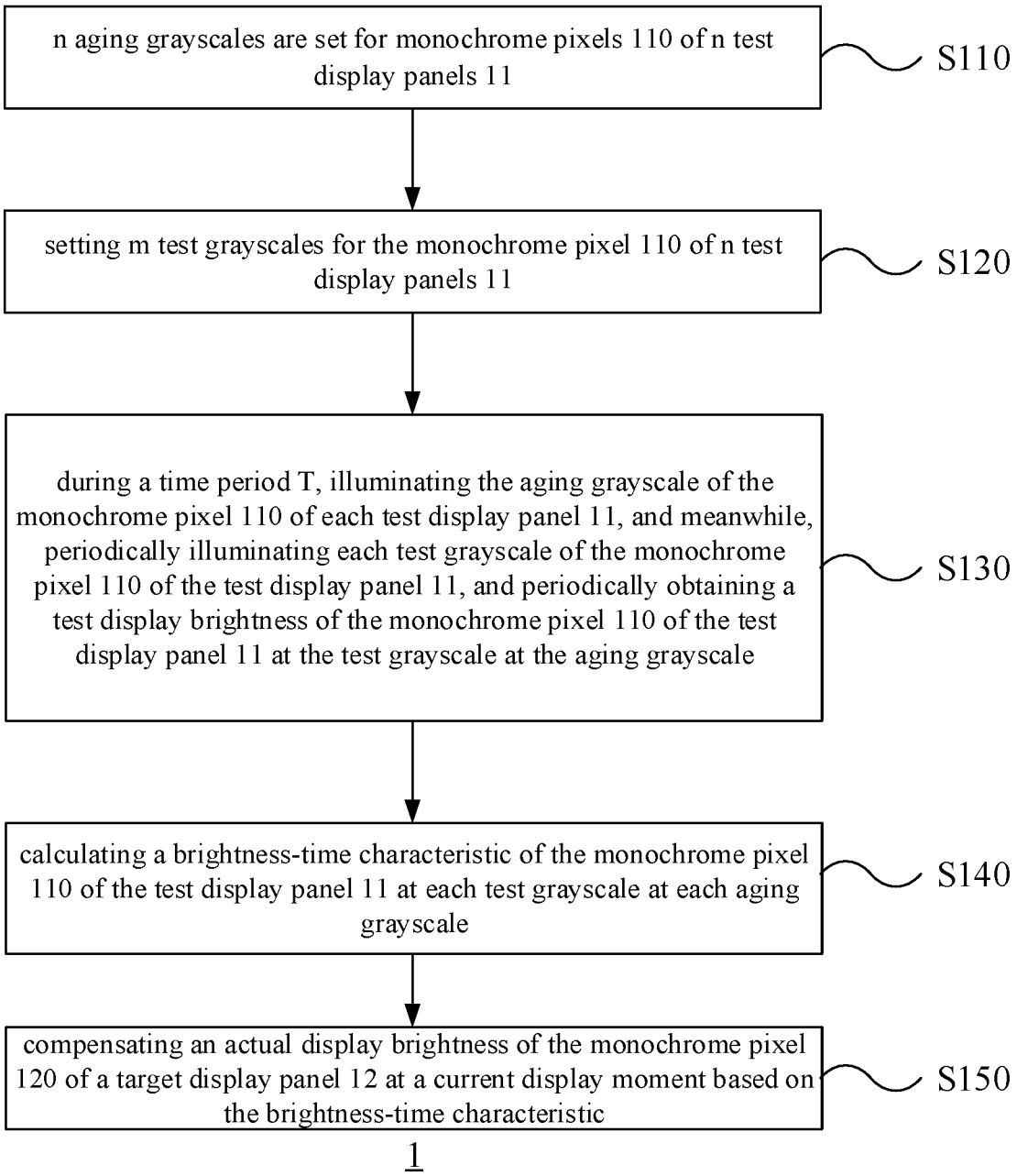
FIG. 2 is a schematic diagram of a flowchart of a display brightness compensation method according to an embodiment of the present disclosure.
Figure 3:
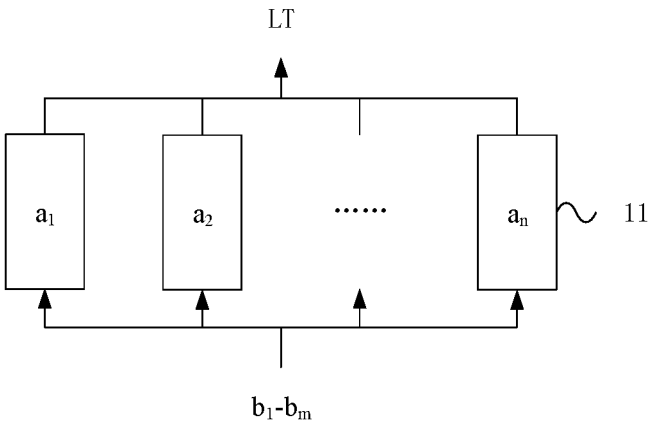
FIG. 3 is a schematic diagram of aging grayscales and test grayscales of a test display panel in a display brightness compensation method according to an embodiment of the present disclosure.
Figure 4:
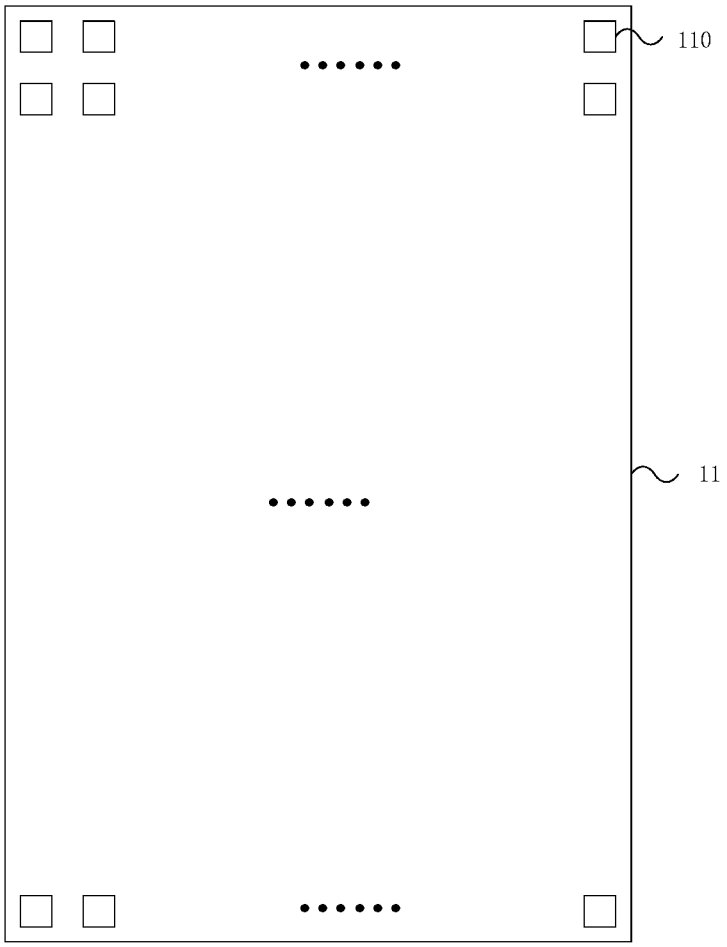
FIG. 4 is a schematic diagram of a structure of a test display panel in a display brightness compensation method according to an embodiment of the present disclosure.
Figure 5:
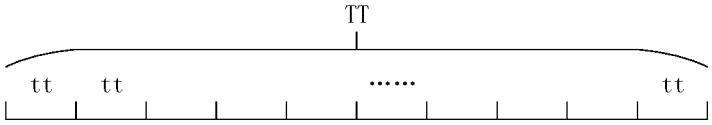
FIG. 5 is a time sequence diagram of a display brightness compensation method according to an embodiment of the present disclosure.
Figure 6:
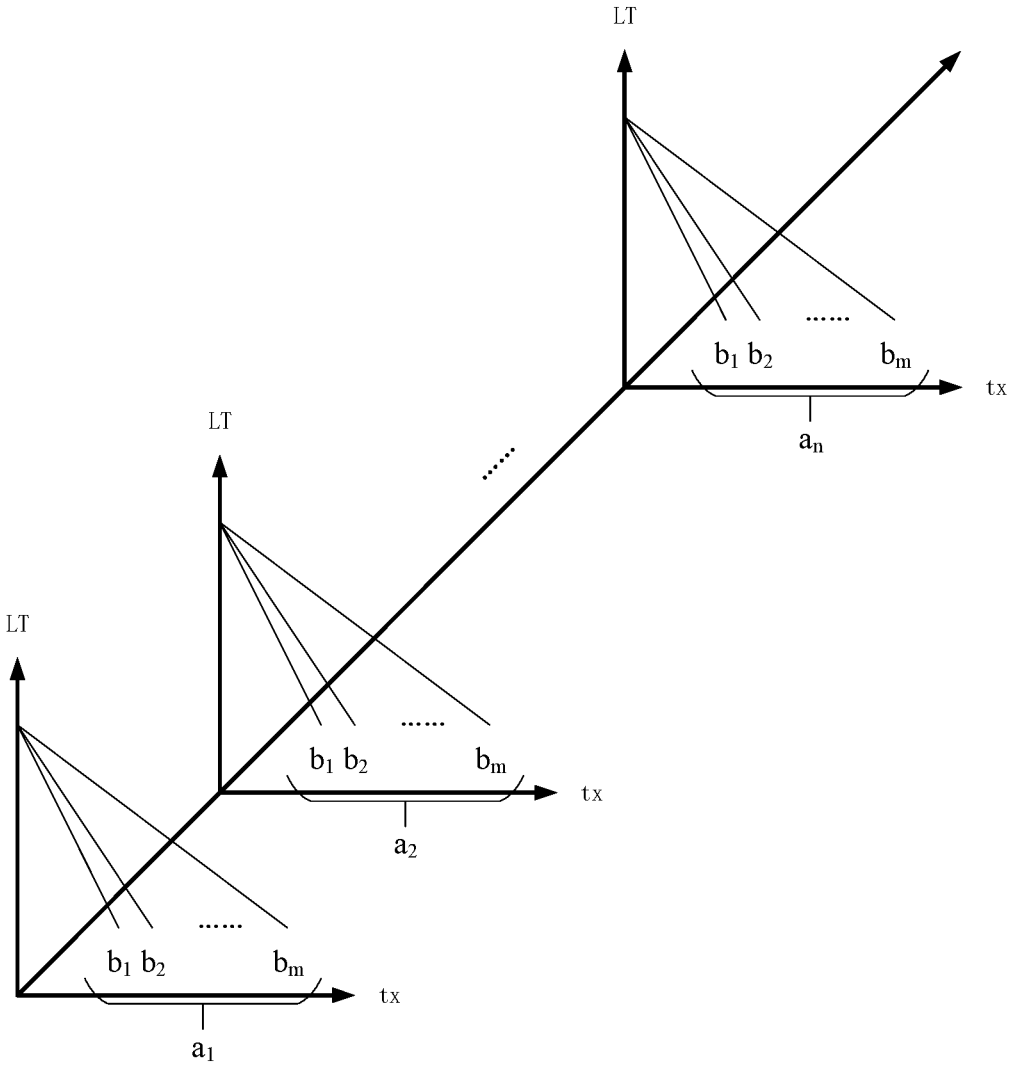
FIG. 6 is a schematic diagram of brightness-time characteristics of a test display panel in a display brightness compensation method according to an embodiment of the present disclosure.
Figure 7:
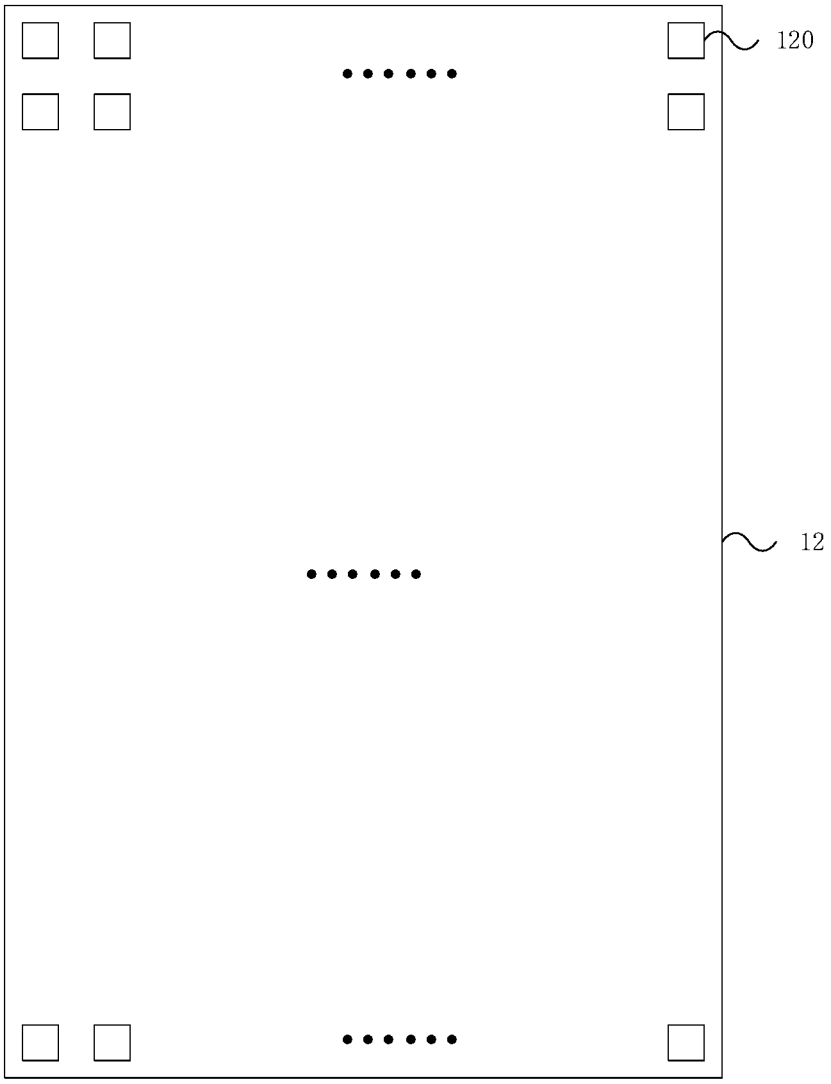
FIG. 7 is a schematic diagram of a structure of a target display panel in a display brightness compensation method according to an embodiment of the present disclosure.
Figure 8:
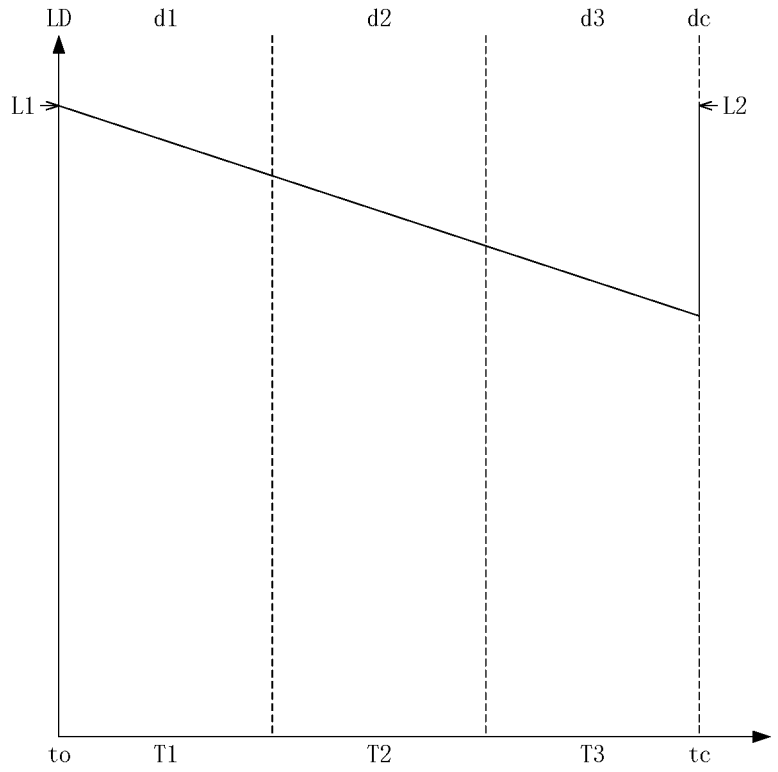
FIG. 8 is a schematic diagram of brightness-time characteristics of a target display panel in a display brightness compensation method according to an embodiment of the present disclosure.

FIG. 2 is a schematic diagram of a flowchart of a display brightness compensation method according to an embodiment of the present disclosure; FIG. 3 is a schematic diagram of aging grayscales and test grayscales of a test display panel in a display brightness compensation method according to an embodiment of the present disclosure; FIG. 4 is a schematic diagram of a structure of a test display panel in a display brightness compensation method according to an embodiment of the present disclosure; FIG. 5 is a time sequence diagram of a display brightness compensation method according to an embodiment of the present disclosure; FIG. 6 is a schematic diagram of brightness-time characteristics of a test display panel in a display brightness compensation method according to an embodiment of the present disclosure; FIG. 7 is a schematic diagram of a structure of a target display panel in a display brightness compensation method according to an embodiment of the present disclosure; and FIG. 8 is a schematic diagram of brightness-time characteristics of a target display panel in a display brightness compensation method according to an embodiment of the present disclosure.

As shown in FIG. 2 to FIG. 8, the display brightness compensation method 1 includes following steps.

At step S110, n aging grayscales $a_1$ to $a_n$ are set for monochrome pixels 110 of n test display panels 11, where n is a positive integer greater than or equal to 2. The monochrome pixels 110 of any two test display panels 11 have different aging grayscales.

The monochrome pixel 110 of a $1^{st}$ test display panel 11 has a $1^{st}$ aging grayscale $a_1$, the monochrome pixel 110 of a $2^{nd}$ test display panel 11 has a $2^{nd}$ aging grayscale $a_2$, the monochrome pixel 110 of an $n^{th}$ test display panel 11 has an $n^{th}$ aging grayscale $a_n$, and so on. Any two of the $1^{st}$ to $n^{th}$ aging grayscales are different. Each aging grayscale is one of grayscales of 0 to 255.

At step S120, m test grayscales $b_1$ to $b_m$ are set for the monochrome pixel 110 of each test display panel 11, where m is a positive integer greater than or equal to 2.

The monochrome pixel 110 of the $1^{st}$ test display panel 11 has m test grayscales $b_1$ to $b_m$, the monochrome pixel 110 of the $2^{nd}$ test display panel 11 has m test grayscales $b_1$ to $b_m$, the monochrome pixel 110 of the $n^{th}$ test display panel 11 has m test grayscales $b_1$ to $b_m$, and so on. The m test grayscales include $1^{st}$ to $m^{th}$ test grayscales $b_1$ to $b_m$. Any two of the $1^{st}$ to $m^{th}$ test grayscales $b_1$ to $b_m$ are different. Each test grayscale is one of grayscales of 0 to 255.

At step S130, during a time period TT, the aging grayscale of the monochrome pixel 110 of each test display panel 11 is illuminated, and meanwhile, each test grayscale of the monochrome pixel 110 of the test display panel 11 is periodically illuminated, and a test display brightness LT of the monochrome pixel 110 of the test display panel 11 at the test grayscale at the aging grayscale is periodically obtained.

One time period TT includes a plurality of periods tt. An initial display moment of one time period TT coincides with an initial display moment of a $1^{st}$ period tt, an end moment of the $1^{st}$ period tt coincides with an initial display moment of a $2^{nd}$ period tt, an end moment of the $2^{nd}$ period tt coincides with an initial display moment of a $3^{rd}$ period tt, an end moment of the last period tt coincides with an end moment of the time period TT, and so on. At the initial display moment of the $1^{st}$ period tt, the monochrome pixel 110 of at least one test display panel 11 illuminates $1^{st}$ to $m^{th}$ test grayscales $b_1$ to $b_m$, and meanwhile, the test display brightness LT of the monochrome pixel 110 of the at least one test display panel 11 on each of the $1^{st}$ to $m^{th}$ test grayscales $b_1$ to $b_m$ is obtained. During a time period between the initial display moment and the end moment of the $1^{st}$ period tt, the monochrome pixels 110 of the n test display panels 11 respectively illuminate the respective aging grayscales. At the initial display moment of the $2^{nd}$ period tt, the monochrome pixel 110 of at least one test display panel 11 illuminates the $1^{st}$ to $m^{th}$ test grayscales $b_1$ to $b_m$, and meanwhile, the test display brightness LT of the monochrome pixel 110 of at least one test display panel 11 on each of the $1^{st}$ to $m^{th}$ test grayscales $b_1$ to $b_m$ is obtained. During a time period between the initial display moment and the end moment of the $2^{nd}$ period tt, the monochrome pixel 110 of the n test display panels 11 respectively illuminates the respective aging grayscales. At the initial display moment of the last period tt, the monochrome pixel 110 of at least one test display panel 11 illuminates $1^{st}$ to $m^{th}$ test grayscales $b_1$ to $b_m$, and meanwhile, the test display brightness LT of the monochrome pixel 110 of at least one test display panel 11 on each of the $1^{st}$ to $m^{th}$ test grayscales $b_1$ to $b_m$ is obtained. During a time period between the initial display moment and the end moment of the last period tt, the monochrome pixel 110 of then test display panels 11 respectively illuminates the respective aging grayscales. At the end moment of the last period tt, the monochrome pixel 110 of at least one test display panel 11 illuminates $1^{st}$ to $m^{th}$ test grayscales $b_1$ to $b_m$, and meanwhile, the test display brightness LT of the monochrome pixel 110 of at least one test display panel 11 on each of the $1^{st}$ to $m^{th}$ test grayscales $b_1$ to $b_m$ is obtained. The same applies in each remaining period. In this way, the test display brightness LT of the monochrome pixel 110 of at least one test display panel 11 on each of the $1^{st}$ to $m^{th}$ test grayscales $b_1$ to $b_m$ at the initial display moment or the end moment of each of the $1^{st}$ to last period tt is obtained.

At step S140, a brightness-time characteristic of the monochrome pixel 110 of the test display panel 11 at each test grayscale at each aging grayscale is calculated.

As explained above, the test display brightness LT of the monochrome pixel 110 of at least one test display panel 11 at each of the $1^{st}$ to $m^{th}$ test grayscales $b_1$ to $b_m$ at the initial display moment or the end moment of each of the $1^{st}$ to last period tt is obtained. In one embodiment, a brightness-time characteristic of the monochrome pixel 110 of at least one test display panel 11 at each of the $1^{st}$ to $m^{th}$ test grayscales $b_1$ to $b_m$ is calculated, and so on for remaining test display panel 11. Thus, at this step, the brightness-time characteristic of the monochrome pixel 110 of the test display panel 11 at each of the $1^{st}$ to $m^{th}$ test grayscales $b_1$ to $b_m$ at each of the $1^{st}$ to $n^{th}$ aging grayscales $a_1$ to $a_n$ is obtained. As shown in FIG. 6, the brightness-time characteristic of the monochrome pixel 110 of the test display panel 11 at each of the $1^{st}$ to $m^{th}$ test grayscales $b_1$ to bn at each of the $1^{st}$ to $n^{th}$ aging grayscales $a_1$ to $a_n$ reflects a relation between the test display brightness LT and the test aging time tx. The test aging time tx includes the time period TT described above.

At step S150, an actual display brightness LD of the monochrome pixel 120 of a target display panel 12 at a current display moment tc is compensated based on the brightness-time characteristic.

Here, the brightness-time characteristic of the monochrome pixel 110 of the test display panel 11 at each of the $1^{st}$ to $m^{th}$ test grayscales $b_1$ to $b_m$ at each of the $1^{st}$ to $n^{th}$ aging grayscales $a_1$ to $a_n$ is written into the target display panel 12. A monochrome pixel 120 of the target display panel 12 has an initial display brightness L1 at an initial display moment to. The target display panel 12 records the initial display brightness L1 of the monochrome pixel 120 of the target display panel 12 at the initial display moment t0. Thereafter, the monochrome pixel 120 of the target display panel 12 has an actual display brightness L2 at the current display moment tc. The monochrome pixel 120 of the target display panel 12 sequentially passes a first display time period T1, a second display time period T2, and a third display time period T3 from the initial display moment t0 to the current display moment tc. The monochrome pixel 120 of the target display panel 12 has a $1^{st}$ sub-display grayscale d1 in the first display time period T1. The monochrome pixel 120 of the target display panel 12 has a $2^{nd}$ sub-display grayscale d2 in the second display time period T2. The monochrome pixel 120 of the target display panel 12 has a $3^{rd}$ sub-display grayscale d3 in the third display time period T3. The $1^{st}$ sub-display grayscale d1, the $2^{nd}$ sub-display grayscale d2, and the $3^{rd}$ sub-display grayscale d3 are different from one another. The $1^{st}$ sub-display grayscale d1, the $2^{nd}$ sub-display grayscale d2, and the $3^{rd}$ sub-display grayscale d3 each are one of grayscales of 0 to 255. The target display panel 12 determines that the $1^{st}$ sub-display grayscale d1 is the same as the $1^{st}$ aging grayscale $a_1$. An attenuation amount of a brightness of the monochrome pixel 120 of the target display panel 12 at the $1^{st}$ sub-display grayscale d1 in the first display time period T1 is the same as an attenuation amount of a brightness of the monochrome pixel 120 of the target display panel 12 at the $1^{st}$ aging grayscale $a_1$ after passing a first aging time period T1'. An attenuation amount of a brightness of the monochrome pixel 120 of the target display panel 12 at the $2^{nd}$ sub-display grayscale d2 in the second display time period T2 is the same as an attenuation amount of a brightness of the monochrome pixel 120 of the target display panel 12 at the $1^{st}$ aging grayscale $a_1$ after passing a second aging time period T2'. An attenuation amount of a brightness of the monochrome pixel 120 of the target display panel 12 at the $3^{rd}$ sub-display grayscale d3 in the third display time period T3 is the same as an attenuation amount of a brightness of the monochrome pixel 120 of the target display panel 12 at the $1^{st}$ aging grayscale $a_1$ after passing a third aging time period T3'. The target display panel 12 obtains the first to third aging time periods T1' to T3' at the $1^{st}$ aging grayscale $a_1$ based on the first display time period T1, the second display time period T2, and the third display time period T3 at the $1^{st}$ to $3^{rd}$ sub-display grayscales. Then, the target display panel 12 obtains a sum TS of the aging time periods of the first to third aging time periods T1' to T3'. The target display panel 12 determines that the monochrome pixel 120 of the target display panel 12 has a current display grayscale dc at the current display moment tc. The target display panel 12 determines that the current display grayscale dc corresponds to one of the m test grayscales $b_1$ to $b_m$. The target display panel 12 determines the brightness-time characteristic of the monochrome pixel 120 of the target display panel 12 at the test grayscale corresponding to the current display grayscale dc at the $1^{st}$ aging grayscale d1 corresponding to the $1^{st}$ sub-display grayscale d1. Therefore, the target display panel 12 obtains an attenuation amount of the brightness of the monochrome pixel 120 of the target display panel 12 after passing the sum TS of aging time periods from the initial display moment t0. The attenuation amount of the brightness of the monochrome pixel 120 of the target display panel 12 after passing the sum TS of aging time periods from the initial display moment t0 is equal to an attenuation amount of the brightness of the monochrome pixel 120 of the target display panel 12 from the initial display moment t0 to the current display moment tc. The target display panel 12 compensates the attenuation amount of the brightness of the monochrome pixel 120 of the target display panel 12 from the initial display moment t0 to the current display moment tc. After compensation, a ratio of the actual display brightness L2 of the monochrome pixel 120 of the target display panel 12 at the current display moment tc to the initial display brightness L1 of the monochrome pixel 120 of the target display panel 12 at the initial display moment t0 is greater than 0.99 and smaller than 1.01. Therefore, the display brightness of the monochrome pixel 120 of the target display panel 12 is the same or tends to be the same at different display moments. A case in which the monochrome pixel 120 of the target display panel 12 sequentially passes the first display time period T1, the second display time period T2, and the third display time period T3 from the initial display moment t0 to the current display moment tc is only an example, and the same applies for a case in which the monochrome pixel 120 of the target display panel 12 sequentially passes more than three display time periods from the initial display moment t0 to the current display moment tc.

In this embodiment, the display brightness compensation method 1 is used to compensate the display brightness of the target display panel 12. First, the brightness-time characteristic of the monochrome pixel 110 of the test display panel 11 at each of the $1^{st}$ to $m^{th}$ test grayscales $b_1$ to $b_m$ at each of the $1^{st}$ to $n^{th}$ aging grayscales $a_1$ to $a_n$ is obtained. The brightness-time characteristic of the monochrome pixel 110 of the test display panel 11 on each of the $1^{st}$ to $m^{th}$ test grayscales $b_1$ to $b_m$ on each of the $1^{st}$ to $n^{th}$ aging grayscales $a_1$ to $a_n$ is written into the target display panel 12. Thus, the target display panel 12 obtains the attenuation amount of the brightness of the monochrome pixel 120 of the target display panel 12 from the initial display moment t0 to the current display moment tc. The target display panel 12 compensates the attenuation amount of the brightness of the monochrome pixel 120 of the target display panel 12 from the initial display moment t0 to the current display moment tc. After the compensation, the ratio of the actual display brightness L2 of the monochrome pixel 120 of the target display panel 12 at the current display moment tc to the initial display brightness L1 of the monochrome pixel 120 of the target display panel 12 at the initial display moment t0 is greater than 0.99 and smaller than 1.01. Therefore, the display brightness of the monochrome pixel 120 of the target display panel 12 is the same or tends to be the same at different display moments.

Figure 9:
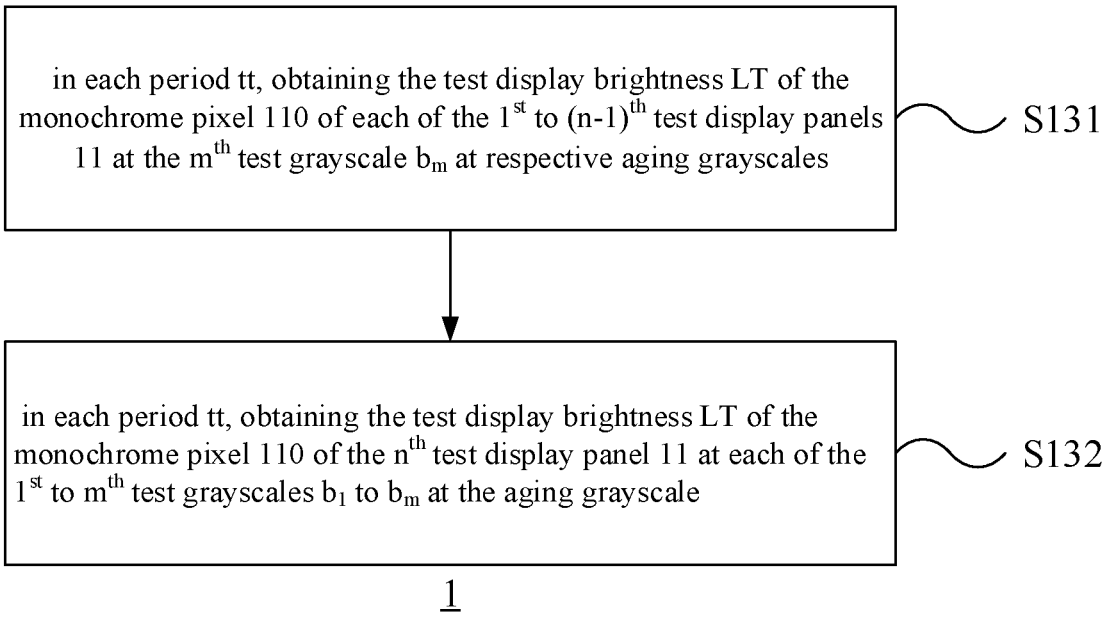
FIG. 9 is a schematic diagram of a flowchart of another display brightness compensation method according to an embodiment of the present disclosure.

FIG. 9 is a schematic diagram of a flowchart of another display brightness compensation method according to an embodiment of the present disclosure.

As shown in FIG. 3 to FIG. 5, and FIG. 9, the process during which the test display brightness LT of the monochrome pixel 110 of the test display panel 11 at the test grayscale at the aging grayscale is obtained includes following steps.

At step S131, in each period tt, the test display brightness LT of the monochrome pixel 110 of each of the $1^{st}$ to $(n-1)^{th}$ test display panels 11 at the $m^{th}$ test grayscale $b_m$ at the respective aging grayscale is obtained.

At step S132, in each period tt, the test display brightness LT of the monochrome pixel 110 of the $n^{th}$ test display panel 11 at each of the $1^{st}$ to $m^{th}$ test grayscales $b_1$ to $b_m$ at the respective aging grayscale is obtained.

The periods tt here include the $1^{st}$ period tt to the last period tt. At an initial moment of each of the $1^{st}$ period tt to the last period tt, the test display brightness LT of the monochrome pixel 110 of each of the $1^{st}$ to $(n-1)^{th}$ test display panels 11 at the $m^{th}$ test grayscale $b_m$ at respective aging grayscales is obtained, and meanwhile, the test display brightness LT of the monochrome pixel 110 of the $n^{th}$ test display panel 11 at each of the $1^{st}$ to $m^{th}$ test grayscales $b_1$ to $b_m$ at respective aging grayscales is obtained. At an end moment of the last period tt, the test display brightness LT of the monochrome pixel 110 of each of the $1^{st}$ to $(n-1)^{th}$ test display panels 11 at the $m^{th}$ test grayscale $b_m$ at respective aging grayscales is obtained, and meanwhile, the test display brightness LT of the monochrome pixel 110 of the $n^{th}$ test display panel 11 at each of the $1^{st}$ to $m^{th}$ test grayscales $b_1$ to $b_m$ at respective aging grayscales is obtained. In the $1^{st}$ period tt to the last period tt, the test display brightness LT of the monochrome pixel 110 of each of the $1^{st}$ to $(n-1)^{th}$ test display panels 11 at each of the $1^{st}$ to $(m-1)^{th}$ test grayscales at respective aging grayscales is not obtained. The step at which the test display brightness LT of the monochrome pixel 110 of the test display panel 11 at the test grayscale at the aging grayscale is obtained is simplified. Therefore, this can save time and effort for the process of the display brightness compensation method 1.

Figure 10:
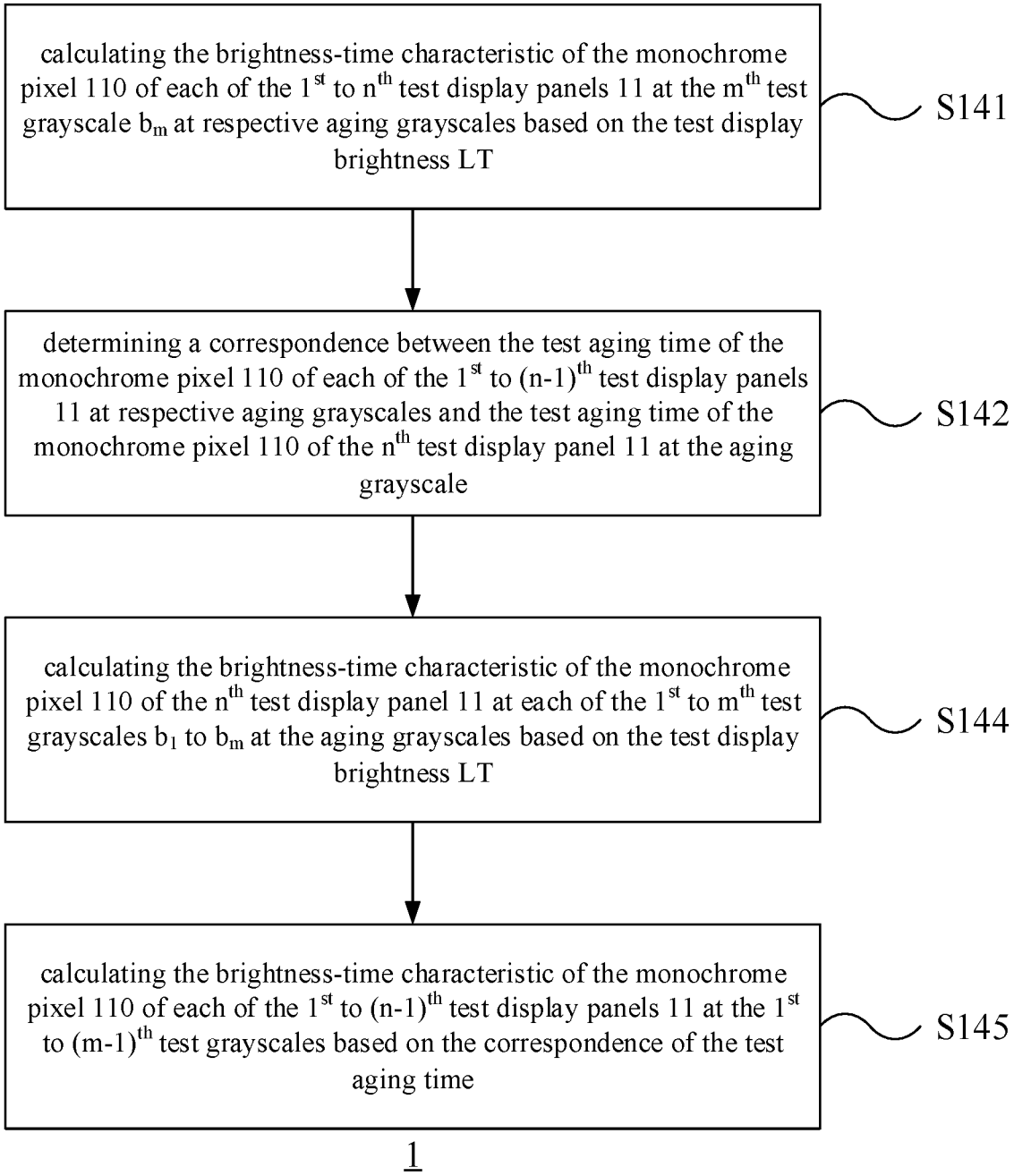
FIG. 10 is a schematic diagram of a flowchart of another display brightness compensation method according to an embodiment of the present disclosure.
Figure 11:
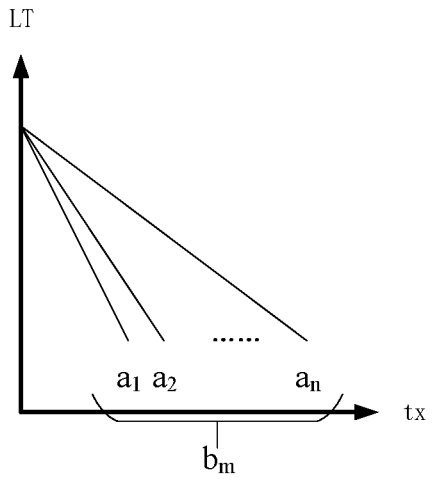
FIG. 11 is another schematic diagram of brightness-time characteristics of a test display panel in another display brightness compensation method according to an embodiment of the present disclosure.
Figure 12:
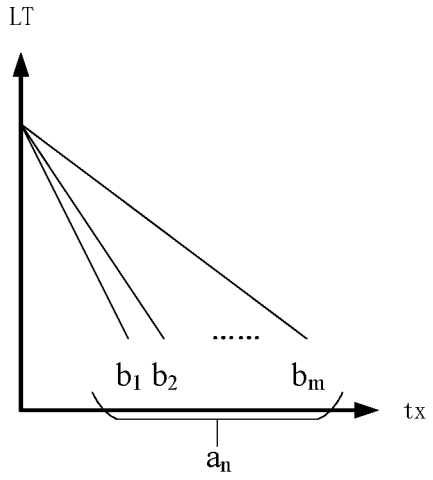
FIG. 12 is another schematic diagram of brightness-time characteristics of a test display panel in another display brightness compensation method according to an embodiment of the present disclosure.

FIG. 10 is a schematic diagram of a flowchart of another display brightness compensation method according to an embodiment of the present disclosure; FIG. 11 is another schematic diagram of brightness-time characteristics of test display panels in another display brightness compensation method according to an embodiment of the present disclosure; and FIG. 12 is another schematic diagram of brightness-time characteristics of a test display panel in another display brightness compensation method according to an embodiment of the present disclosure.

As shown in FIG. 3, FIG. 4, FIG. 10 to FIG. 12, the process during which the brightness-time characteristic of the monochrome pixel 110 of the test display panel 11 on each test grayscale on each aging grayscale is calculated includes following steps.

At step S141, the brightness-time characteristic of the monochrome pixel 110 of each of the $1^{st}$ to $n^{th}$ test display panel 11 at the $m^{th}$ test grayscale $b_m$ at respective aging grayscales is calculated based on the test display brightness LT.

At step S144, the brightness-time characteristic of the monochrome pixel 110 of the $n^{th}$ test display panel 11 at each of the $1^{st}$ to $m^{th}$ test grayscales $b_1$ to $b_m$ at respective aging grayscales is calculated based on the test display brightness LT.

As explained above, in each of the $1^{st}$ period tt to the last period tt, the test display brightness LT of the monochrome pixel 110 of each of the $1^{st}$ to $(n-1)^{th}$ test display panels 11 at the $m^{th}$ test grayscale $b_m$ at respective aging grayscales is obtained. In one embodiment, at this step, the brightness-time characteristic of the monochrome pixel 110 of each of the $1^{st}$ to $(n-1)^{th}$ test display panels 11 at the $m^{th}$ test grayscale $b_m$ at respective aging grayscales is calculated. The brightness-time characteristic of the monochrome pixel 110 of each of the $1^{st}$ to $(n-1)^{th}$ test display panels 11 on the $m^{th}$ test grayscale $b_m$ on the respective aging grayscale reflects a relation between the test display brightness LT and the test aging time tx. The test aging time tx includes $1^{st}$ to last periods tt. The obtained test pixel brightness LT of the monochrome pixel 110 of each of the $1^{st}$ to $(n-1)^{th}$ test display panels 11 at the $m^{th}$ test grayscale $b_m$ at respective aging grayscales is true and accurate. Thus, the calculated brightness-time characteristic of the monochrome pixel 110 of each of the $1^{st}$ to $(n-1)^{th}$ test display panels 11 at the $m^{th}$ test grayscale $b_m$ at respective aging grayscales is true and accurate. As described above, in each of the $1^{st}$ period tt to the last period tt, the test display brightness LT of the monochrome pixel 110 of each of the $1^{st}$ to $(n-1)^{th}$ test display panels 11 at the $m^{th}$ test grayscale $b_m$ at respective aging grayscales is obtained. In one embodiment, the brightness-time characteristic of the monochrome pixel 110 of the $n^{th}$ test display panel 11 at each of the $1^{st}$ to $m^{th}$ test grayscales $b_1$ to $b_m$ at respective aging grayscales is calculated. The brightness-time characteristic of the monochrome pixel 110 of the $n^{th}$ test display panel 11 at each of the $1^{st}$ to $m^{th}$ test grayscales $b_1$ to $b_m$ at respective aging grayscales reflects a relation between the test display brightness LT and test aging time tx. The test aging time tx includes $1^{st}$ to last periods tt. The obtained test display brightness LT of the monochrome pixel 110 of each of the $1^{st}$ to $(n-1)^{th}$ test display panels 11 at the $m^{th}$ test grayscale $b_m$ at respective aging grayscales is true and accurate. Thus, the calculated brightness-time characteristic of the monochrome pixel 110 of the $n^{th}$ test display panel at on each of the $1^{st}$ to $m^{th}$ test grayscales $b_1$ to $b_m$ at respective aging grayscales is true and accurate.

As shown in FIG. 3, FIG. 4, and FIG. 10 to FIG. 12, the display brightness compensation method 1 further includes a following step.

After the step at which the brightness-time characteristic of the monochrome pixel 110 of each of the $1^{st}$ to $n^{th}$ test display panel 11 at the $m^{th}$ test grayscale $b_m$ at respective aging grayscales is calculated based on the test display brightness LT, at step S142, a correspondence between the test aging time of the monochrome pixel 110 of each of the $1^{st}$ to $(n-1)^{th}$ test display panels 11 at respective aging grayscales and the test aging time of the monochrome pixel 110 of the $n^{th}$ test display panel 11 at respective aging grayscales is determined.

The brightness-time characteristic of the monochrome pixel 110 of each of the $1^{st}$ to $n^{th}$ test display panels 11 at the $m^{th}$ test grayscale $b_m$ at respective aging grayscales reflects the relation between the test display brightness LT and the test aging time tx. Thus, the correspondence between the test aging time of the monochrome pixel 110 of each test display panel 11 except the $n^{th}$ test display panel 11 at respective aging grayscales and the test aging time of the monochrome pixel 110 of the $n^{th}$ test display panel 11 at its aging grayscale is determined. For example, the time spent in a process during which the display brightness of the monochrome pixel 110 of the $1^{st}$ test display panel 11 at the $m^{th}$ test grayscale $b_m$ at its aging grayscale changes from the first display brightness to the second display brightness is $1^{st}$ aging time. The time spent in a process during which the display brightness of the monochrome pixel 110 of the $n^{th}$ test display panel 11 at the $m^{th}$ test grayscale $b_m$ at its aging grayscale changes from the first display brightness to the second display brightness is $n^{th}$ aging time. The first display brightness is greater than the second display brightness. The $n^{th}$ aging time is equal to half of the $1^{st}$ aging time. The test aging time of the monochrome pixel 110 of the $1^{st}$ test display panel 11 at its aging grayscale is ft1. The test aging time of the monochrome pixel 110 of the $n^{th}$ test display panel 11 at its aging grayscale is ftn. A correspondence between the test aging time of the monochrome pixel 110 of the $1^{st}$ test display panel 11 at its aging grayscale and the test aging time of the monochrome pixel 110 of the $n^{th}$ test display panel 11 at its aging grayscale is as follows: ftn=0.5 ft1. A correspondence between the test aging time of the monochrome pixel 110 of any one of the $1^{st}$ to $(n-1)^{th}$ test display panels 11 at the respective aging grayscale and the test aging time of the monochrome pixel 110 of the $n^{th}$ test display panel 11 at its aging grayscale can be determined in the same way.

As shown in FIGS. 3, 4, 6, and 10-12, the display brightness compensation method 1 can further include following steps.

After the brightness-time characteristic of the monochrome pixel 110 of the $n^{th}$ test display panel 11 at each of the $1^{st}$ to $m^{th}$ test grayscales $b_1$ to $b_m$ at its aging grayscale is calculated based on the test display brightness LT, at step S145, the brightness-time characteristic of the monochrome pixel 110 of each of the $1^{st}$ to $(n-1)^{th}$ test display panels 11 at the $1^{st}$ to $(m-1)^{th}$ test grayscales is calculated based on the correspondence of the test aging time.

The brightness-time characteristic of the monochrome pixel 110 of the $n^{th}$ test display panel 11 at each of the $1^{st}$ to $m^{th}$ test grayscales $b_1$ to $b_m$ at its aging grayscale reflects a relation between the test display brightness LD and the test aging time tx. The correspondence between the test aging time of the monochrome pixel 110 of each test display panel 11 except the $n^{th}$ test display panel 11 at the respective aging grayscale and the aging time of the monochrome pixel 110 of the $n^{th}$ test display panel 11 at its aging grayscale has been determined. Therefore, the brightness-time characteristic of the monochrome pixel 110 of each of the $1^{st}$ to $(n-1)^{th}$ test display panels 11 at each of the $1^{st}$ to $(m-1)^{th}$ test grayscales is calculated based on the correspondence of the test aging time. For example, the test aging time of the monochrome pixel 110 of the $1^{st}$ test display panel 11 at the aging grayscale is ft1. The test aging time of the monochrome pixel 110 of the $n^{th}$ test display panel 11 at the aging grayscale is ftn. The correspondence between the test aging time of the monochrome pixel 110 of the $1^{st}$ test display panel 11 at the aging grayscale and the test aging time of the monochrome pixel 110 of the $n^{th}$ test display panel 11 at the aging grayscale is as follows: ftn=0.5 ft1. The test aging time fin corresponding to the brightness-time characteristic of the monochrome pixel 110 of the $n^{th}$ test display panel 11 at each of the $1^{st}$ to $m^{th}$ test grayscales $b_1$ to $b_m$ is changed into 0.5 ft1. The brightness-time characteristic of the monochrome pixel 110 of the $n^{th}$ test display panel 11 at the aging grayscale is changed into the brightness-time characteristic of the monochrome pixel 110 of the $1^{st}$ test display panel 11 at the aging grayscale. The brightness-time characteristic of the monochrome pixel 110 of the $1^{st}$ test display panel 11 at each of the $1^{st}$ to $m^{th}$ test grayscales $b_1$ to $b_m$ at the aging grayscale is determined. The brightness-time characteristic of the monochrome pixel 110 of each of the 2nd to $(n-1)^{th}$ test display panels 11 at the $1^{st}$ to $m^{th}$ test grayscales $b_1$ to $b_m$ at the respective aging grayscale can be determined in the same way. Then, as shown in FIG. 6, the brightness-time characteristic of the monochrome pixel 110 of each of the $1^{st}$ to $n^{th}$ test display panels 11 at each of the $1^{st}$ to $m^{th}$ test grayscales $b_1$ to $b_m$ is obtained.

In this embodiment, first, the brightness-time characteristic of the monochrome pixel 110 of each of the $1^{st}$ to $n^{th}$ test display panels 11 at the $m^{th}$ test grayscale $b_m$ at the respective aging grayscale is calculated based on the test display brightness LT. At the same time, the brightness-time characteristic of the monochrome pixel 110 of the $n^{th}$ test display panel 11 at each of the $1^{st}$ to $m^{th}$ test grayscales $b_1$ to $b_m$ at the aging grayscale is calculated based on the test display brightness LT. Then, the brightness-time characteristic of the monochrome pixel 110 of each of the $1^{st}$ to $(n-1)^{th}$ test display panels 11 at each of the $1^{st}$ to $(m-1)^{th}$ test grayscales is calculated. Thus, the brightness-time characteristic of the monochrome pixel 110 of each of the $1^{st}$ to $n^{th}$ test display panels 11 at each of the $1^{st}$ to $m^{th}$ test grayscales $b_1$ to $b_m$ is obtained. Here, data on the brightness-time characteristic of the monochrome pixel 110 of each of the $1^{st}$ to $(n-1)^{th}$ test display panels 11 at each of the $1^{st}$ to $(m-1)^{th}$ test grayscales is directly obtained without testing. This can simplify the step at which the test display brightness LT of the monochrome pixel 110 of the test display panel 11 at the test grayscale at the aging grayscale is obtained. Therefore, this can save time and effort for the process for the display brightness compensation method 1.

As shown in FIG. 2 to FIG. 12, n is an integer smaller than 256.

A number of test display panels 11 is n, which is an integer smaller than 256. The monochrome pixel 110 of one test display panel 11 has a respective aging grayscale. A number of aging grayscales $a_1$ to $a_n$ of the monochrome pixels 110 of the n test display panels 11 is an integer smaller than 256. That is, the number of aging grayscales $a_1$ to $a_n$ of the monochrome pixels 110 of the n test display panels 11 is small. Thus, the step of setting the aging grayscales $a_1$ to $a_n$ of the monochrome pixels 110 of then test display panels 11 is simplified. The step of obtaining the test display brightness LT of the monochrome pixel 110 of the test display panel 11 at the test grayscale at the aging grayscale is simplified. Therefore, the process for the display brightness compensation method 1 saves time and effort.

Figure 13:
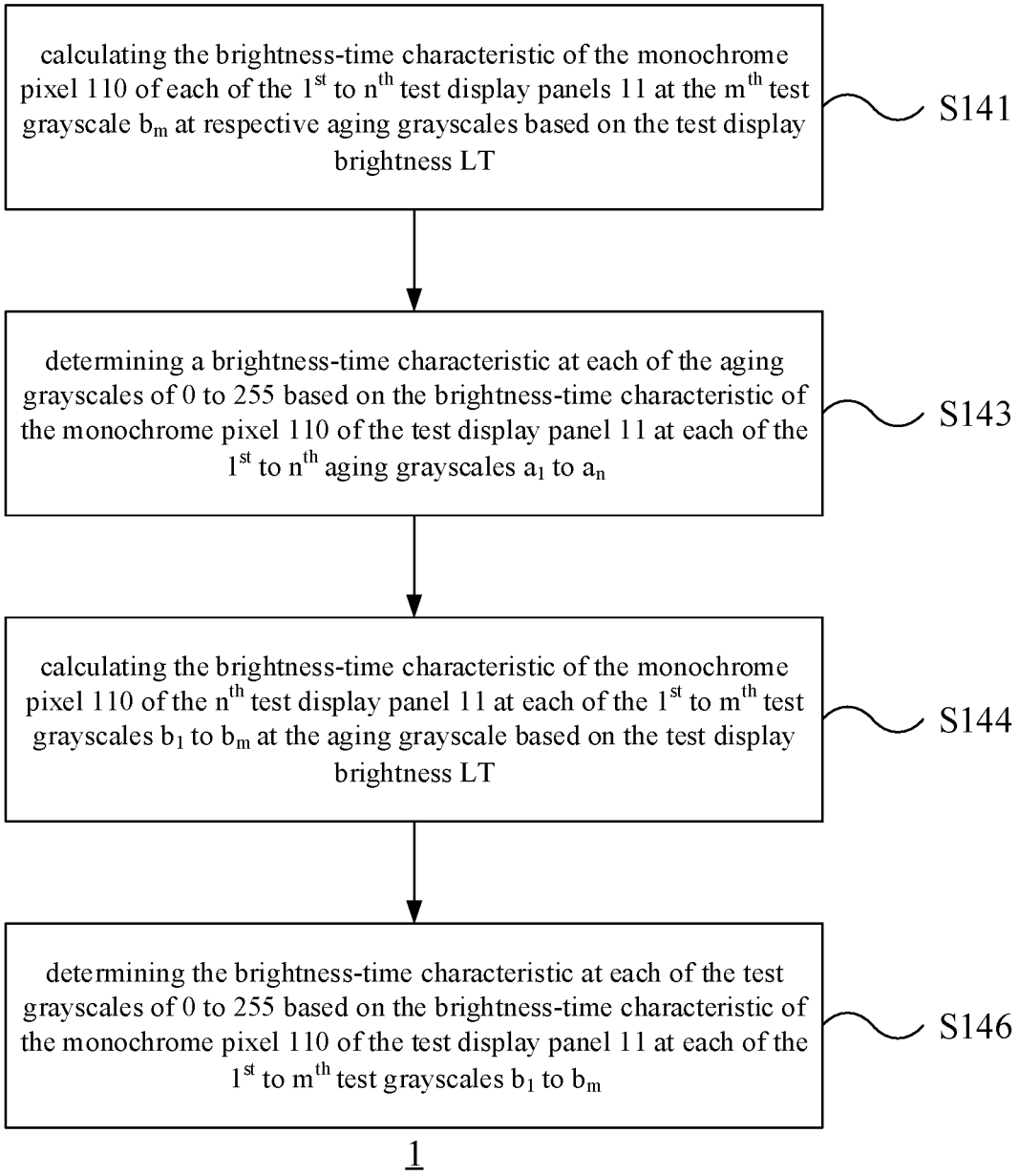
FIG. 13 is a schematic diagram of a flowchart of another display brightness compensation method according to an embodiment of the present disclosure.

FIG. 13 is a schematic diagram of a flowchart of another display brightness compensation method according to an embodiment of the present disclosure.

As shown in FIGS. 3, 4, 6, and 13, the display brightness compensation method 1 further includes a following step.

After the brightness-time characteristic of the monochrome pixel 110 of each of the $1^{st}$ to $n^{th}$ test display panel 11 at the $m^{th}$ test grayscale $b_m$ at the respective aging grayscale is calculated based on the test display brightness LT, at step S143, a brightness-time characteristic at each of the aging grayscales of 0 to 255 is determined based on the brightness-time characteristic of the monochrome pixel 110 of the test display panel 11 at each of the $1^{st}$ to $n^{th}$ aging grayscales $a_1$ to $a_n$.

The number of the aging grayscales $a_1$ to $a_n$ of the monochrome pixels 110 of the n test display panels 11 is smaller than 256. The aging grayscales of the monochrome pixels 110 of then test display panels 11 belong to grayscales of 0 to 255. However, the brightness-time characteristic at each of the aging grayscales of 0 to 255 is determined based on the brightness-time characteristic of the monochrome pixel 110 of the test display panel 11 at each of the $1^{st}$ to $n^{th}$ aging grayscales $a_1$ to $a_n$. For example, the number of aging grayscales of the monochrome pixels 110 of then test display panels 11 is 3. In this case, then test display panels 11 include a $1^{st}$ test display panel 11, a $2^{nd}$ test display panel 11, and a $3^{rd}$ test display panel 11. The aging grayscale of the monochrome pixel 110 of the $1^{st}$ test display panel 11 is a grayscale of 0, the aging grayscale of the monochrome pixel 110 of the $2^{nd}$ test display panel 11 is a grayscale of 1, and the aging grayscale of the monochrome pixel 110 of the $3^{rd}$ test display panel 11 is a grayscale of 255. The brightness-time characteristic of the monochrome pixel 110 of each of the $1^{st}$ to $3^{rd}$ test display panels 11 at each of the m test grayscales $b_1$ to $b_m$ at the respective aging grayscale has been determined. The correspondence between the test aging time of the monochrome pixel 110 of the test display panel 11 at each of the aging grayscales of 2 to 254 and the test aging time of the monochrome pixel 110 of the test display panel 11 at the aging grayscale of 255 can be determined. The time spent in a process during which the display brightness of the monochrome pixel 110 of the test display panel 11 at the aging grayscale of 2 changes from the first display brightness to the second display brightness is t2. The time spent in a process during which the display brightness of the monochrome pixel 110 of the test display panel 11 at the aging grayscale of 255 changes from the first display brightness to the second display brightness is t255. The first display brightness is greater than the second display brightness. The second aging time t255 is equal to half of the first aging time t2. The test aging time of the monochrome pixel 110 of the test display panel 11 at the aging grayscale of 2 is ft2. The test aging time of the monochrome pixel 110 of the test display panel 11 at the aging grayscale of 255 is ftn. A correspondence between the test aging time of the monochrome pixel 110 of the test display panel 11 at the aging grayscale of 2 and the test aging time of the monochrome pixel 110 of the test display panel 11 at the aging grayscale of 255 is fln=0.5 ft2. A correspondence between the test aging time of the monochrome pixel 110 of the test display panel 11 at each of the aging grayscales of 3 to 254 and the test aging time of the monochrome pixel 110 of the test display panel 11 at the aging grayscale of 255 can be determined in the same way. Therefore, the brightness-time characteristic of the monochrome pixel 110 of the test display panel 11 at each of the aging grayscales of 2 to 254 is determined based on the brightness-time characteristic of the monochrome pixel 110 of the test display panel 11 at the aging grayscale of 255. The test aging time ftn corresponding to the brightness-time characteristic of the monochrome pixel 110 of the test display panel 11 at each of the m test grayscales $b_1$ to $b_m$ at the aging grayscale of 255 is changed into 0.5 ft2. The brightness-time characteristic of the monochrome pixel 110 of the test display panel 11 at the aging grayscale of 255 is changed into the brightness-time characteristic of the monochrome pixel 110 of the test display panel 11 at the aging grayscale of 2. The brightness-time characteristic of the monochrome pixel 110 of the test display panel 11 on each of the m test grayscales $b_1$ to $b_m$ at the aging grayscale of 2 is determined. The brightness-time characteristic of the monochrome pixel 110 of the test display panel 11 at each of the m test grayscales $b_1$ to $b_m$ at each of the aging grayscales of 3 to 254 can be determined in the same way. Thus, the brightness-time characteristic of the monochrome pixel 110 of the test display panel 11 at each of the m test grayscales $b_1$ to $b_m$ at each of the aging grayscales of 0 to 255 can be obtained. Data on the brightness-time characteristic of the monochrome pixel 110 of the test display panel 11 at each of the m test grayscales $b_1$ to $b_m$ at each of the aging grayscales of 0 to 255 is more comprehensive. Therefore, the brightness-time characteristic of the monochrome pixel 110 of the test display panel 11 at each of the m test grayscales $b_1$ to $b_m$ at each of the aging grayscales of 0 to 255 has a better effect for display brightness compensation.

As shown in FIG. 2 to FIG. 12, m is an integer smaller than 256.

A number of test grayscales of the monochrome pixel 110 of the test display panel 11 is m, which is an integer smaller than 256. That is, the number of test grayscales of the monochrome pixel 110 of the test display panel 11 is small. Thus, the step of setting m test grayscales $b_1$ to $b_m$ of the monochrome pixel 110 of each test display panel 11 can be simplified. The step of obtaining the test display brightness LT of the monochrome pixel 110 of the test display panel 11 at the test grayscale at the aging grayscale can be simplified. Therefore, this can save time and effort for the process of the display brightness compensation method 1.

As shown in FIGS. 3, 4, 6, and 13, the display brightness compensation method 1 further includes a following step.

After the brightness-time characteristic of the monochrome pixel 110 of the $n^{th}$ test display panel 11 at each of the $1^{st}$ to $m^{th}$ test grayscales $b_1$ to $b_m$ at the respective aging grayscale is calculated based on the test display brightness LT, at step S146, the brightness-time characteristic at each of the test grayscales of 0 to 255 is determined based on the brightness-time characteristic of the monochrome pixel 110 of the test display panel 11 at each of the $1^{st}$ to $m^{th}$ test grayscales $b_1$ to $b_m$.

The number of the $1^{st}$ to $m^{th}$ test grayscales $b_1$ to $b_m$ of the monochrome pixel 110 of the test display panel 11 is smaller than 256. The $1^{st}$ to $m^{th}$ test grayscales $b_1$ to $b_m$ of the monochrome pixel 110 of the test display panel 11 belong to grayscales of 0 to 255. However, the brightness-time characteristic of the monochrome pixel 110 of the test display panel 11 at each of the test grayscales of 0 to 255 is calculated based on the brightness-time characteristic of the monochrome pixel 110 of the test display panel 11 at each of the $1^{st}$ to $m^{th}$ test grayscales $b_1$ to $b_m$. For example, the number of the $1^{st}$ to $m^{th}$ test grayscales $b_1$ to $b_m$ of the monochrome pixel 110 of the test display panel 11 is 3. In this case, the $1^{st}$ test grayscale of the monochrome pixel 110 of the test display panel 11 is a grayscale of 0, the 2nd test grayscale of the monochrome pixel 110 of the test display panel 11 is a grayscale of 2, and the $3^{rd}$ test grayscale of the monochrome pixel 110 of the test display panel 11 is a grayscale of 255. The brightness-time characteristic of the monochrome pixel 110 of the test display panel 11 at each of the $1^{st}$ to $3^{rd}$ test grayscales at each of then aging grayscales $a_1$ to $a_n$ has been determined. A correspondence between the test aging time of the monochrome pixel 110 of the test display panel 11 at any one of the test grayscales of 2 to 254 and the test aging time of the monochrome pixel 110 of the test display panel 11 at the test grayscale of 255 can be determined. The time spent in a process during which the display brightness of the monochrome pixel 110 of the test display panel 11 at the test grayscale of 2 changes from the first display brightness to the second display brightness is t2. The time spent in a process during which the display brightness of the monochrome pixel 110 of the test display panel 11 at the test grayscale of 255 changes from the first display brightness to the second display brightness is t255. The first display brightness is greater than the second display brightness. The second aging time t255 is equal to half of the first aging time t2. The test aging time of the monochrome pixel 110 of the test display panel 11 at the test grayscale of 2 is ft2. The test aging time of the monochrome pixel 110 of the test display panel 11 at the test grayscale of 255 is ftn. A correspondence between the test aging time of the monochrome pixel 110 of the test display panel 11 at the test grayscale of 2 and the test aging time of the monochrome pixel 110 of the test display panel 11 at the test grayscale of 255 is ftn=0.5 ft2. A correspondence between the test aging time of the monochrome pixel 110 of the test display panel 11 at any one of the test grayscales of 3 to 254 and the test aging time of the monochrome pixel 110 of the test display panel 11 at the test grayscale of 255 can be determined in the same way. Therefore, the brightness-time characteristic of the monochrome pixel 110 of the test display panel 11 at any one of the test grayscales of 2 to 254 is determined based on the brightness-time characteristic of the monochrome pixel 110 of the test display panel 11 at the test grayscale of 255. The test aging time ftn corresponding to the brightness-time characteristic of the monochrome pixel 110 of the test display panel 11 at the test grayscale of 255 at each of the n aging grayscales $a_1$ to $a_n$ is changed into 0.5 ft2. The brightness-time characteristic of the monochrome pixel 110 of the test display panel 11 at the test grayscale of 255 is changed into the brightness-time characteristic of the monochrome pixel 110 of the test display panel 11 at the test grayscale of 2. The brightness-time characteristic of the monochrome pixel 110 of the test display panel 11 at the test grayscale of 2 at each of then aging grayscales $a_1$ to $a_n$ is determined. The brightness-time characteristic of the monochrome pixel 110 of the test display panel 11 at each of the test grayscales of 3 to 254 at each of the n aging grayscales $a_1$ to $a_n$ can be determined in the same way. Thus, the brightness-time characteristic of the monochrome pixel 110 of the test display panel 11 at each of the test grayscales of 0 to 255 at each of the n aging grayscales $a_1$ to $a_n$ is obtained. Data on the brightness-time characteristic of the monochrome pixel 110 of the test display panel 11 at each of the test grayscales of 0 to 255 at each of the n aging grayscales $a_1$ to $a_n$ is more comprehensive. Therefore, the brightness-time characteristic of the monochrome pixel 110 of the test display panel 11 at each of the test grayscales of 0 to 255 at each of the n aging grayscales $a_1$ to $a_n$ has a better effect for display brightness compensation.

Figure 14:
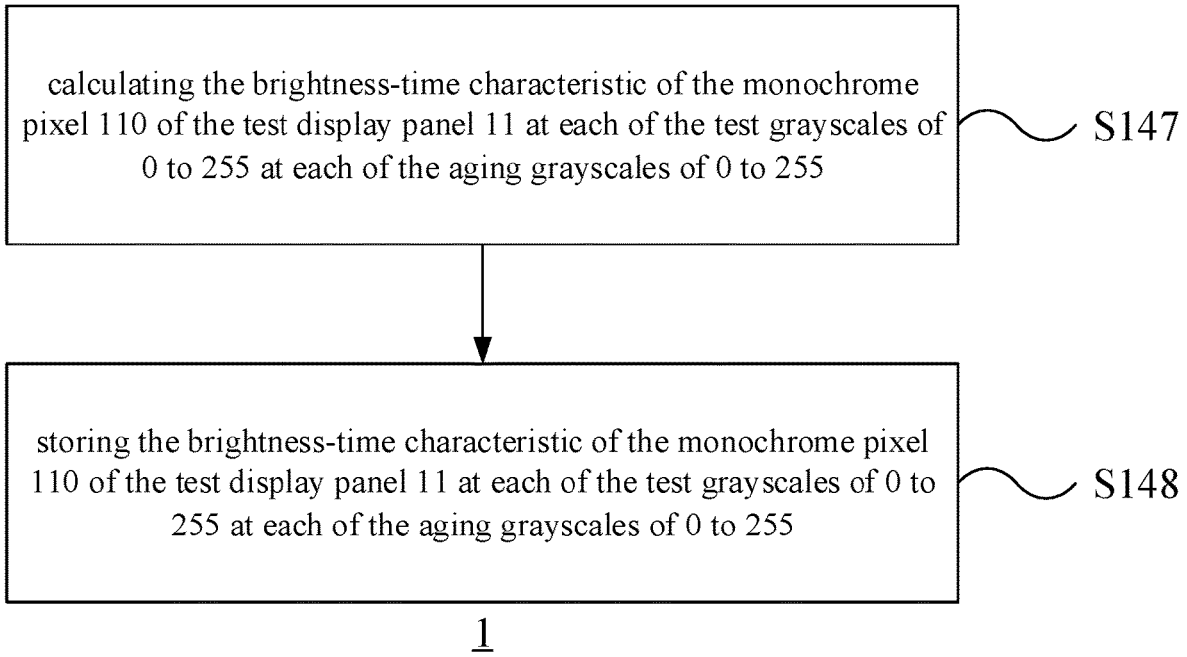
FIG. 14 is a schematic diagram of a flowchart of another display brightness compensation method according to an embodiment of the present disclosure.

FIG. 14 is a schematic diagram of a flowchart of another display brightness compensation method according to an embodiment of the present disclosure.

As shown in FIG. 2 and FIG. 14, the step of calculating the brightness-time characteristic of the monochrome pixel 110 of the test display panel 11 at each test grayscale at each aging grayscale includes a following step.

At step S147, the brightness-time characteristic of the monochrome pixel 110 of the test display panel 11 at each of the test grayscales of 0 to 255 at each of the aging grayscales of 0 to 255 is calculated.

As described above, the brightness-time characteristic of the monochrome pixel 110 of the test display panel 11 at each of the aging grayscales of 0 to 255 is determined based on the brightness-time characteristic of the monochrome pixel 110 of the test display panel 11 at each of the $1^{st}$ to $n^{th}$ aging grayscales $a_1$ to $a_n$, and meanwhile, the brightness-time characteristic of the monochrome pixel 110 of the test display panel 11 at each of the test grayscales of 0 to 255 is determined based on the brightness-time characteristic of the monochrome pixel 110 of the test display panel 11 at each of the $1^{st}$ to $m^{th}$ test grayscales $b_1$ to bin. Therefore, at this step, the brightness-time characteristic of the monochrome pixel 110 of the test display panel 11 at each of the test grayscales of 0 to 255 on each of the aging grayscales of 0 to 255 is calculated. The brightness-time characteristic of the monochrome pixel 110 of the test display panel 11 at each of the test grayscales of 0 to 255 at each of the aging grayscales of 0 to 255 includes data corresponding to full grayscales for the aging grayscale and the test grayscale. Thus, data on the brightness-time characteristic of the monochrome pixel 110 of the test display panel 11 at each of the test grayscales of 0 to 255 at each of the aging grayscales of 0 to 255 is more comprehensive. Therefore, the brightness-time characteristic of the monochrome pixel 110 of the test display panel 11 at each of the test grayscales of 0 to 255 at each of the aging grayscales of 0 to 255 has a better effect for display brightness compensation.

As shown in FIG. 2 and FIG. 14, the display brightness compensation method 1 further includes a following step.

After the brightness-time characteristic of the monochrome pixel 110 of the test display panel 11 at each of the test grayscales of 0 to 255 at each of the aging grayscales of 0 to 255 is calculated, at step S148, the brightness-time characteristic of the monochrome pixel 110 of the test display panel 11 at each of the test grayscales of 0 to 255 at each of the aging grayscales of 0 to 255 is stored.

The calculated brightness-time characteristic of the monochrome pixel 110 of the test display panel 11 at each of the test grayscales of 0 to 255 at each of the aging grayscales of 0 to 255 is written into the target display panel 12. The target display panel 12 stores the brightness-time characteristic of the monochrome pixel 110 of the test display panel 11 at each of the test grayscales of 0 to 255 at each of the aging grayscales of 0 to 255. Thus, the target display panel 12 determines the brightness-time characteristic of the monochrome pixel 120 of the target display panel 12 at each of the test grayscales of 0 to 255 at each of the aging grayscales of 0 to 255. Then, the target display panel 12 displays brightness compensation by using the brightness-time characteristic of the monochrome pixel 120 of the target display panel 12 at each of the test grayscales of 0 to 255 at each of the aging grayscales of 0 to 255.

Figure 15:
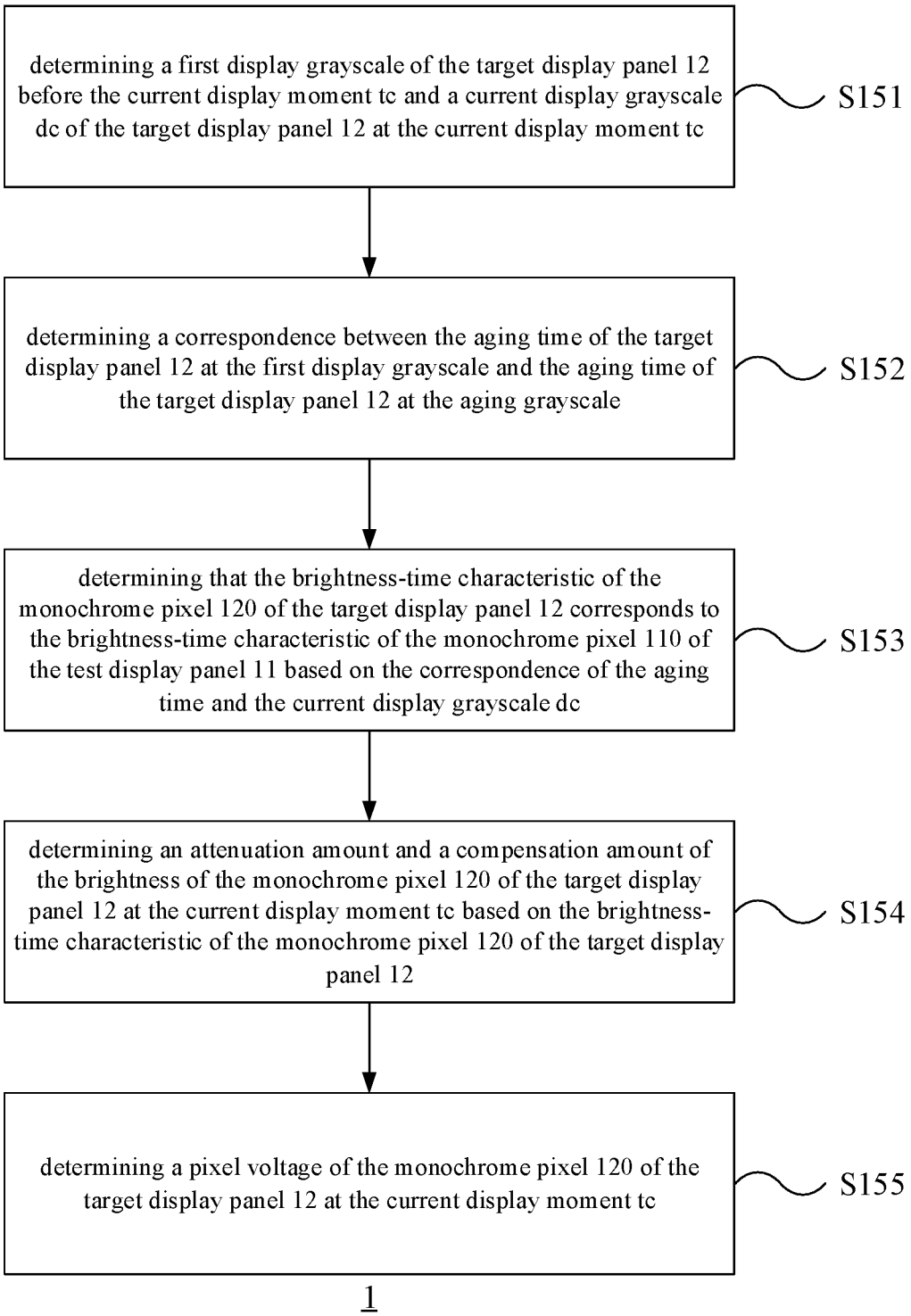
FIG. 15 is a schematic diagram of a flowchart of another display brightness compensation method according to an embodiment of the present disclosure.

FIG. 15 is a schematic diagram of a flowchart of another display brightness compensation method according to an embodiment of the present disclosure.

As shown in FIGS. 2, 6, 7, 8 and 15, the step of compensating the actual display brightness LD of the monochrome pixel 120 of the target display panel 12 at a current display moment tc based on the brightness-time characteristic includes following steps.

At step S151, a first display grayscale of the target display panel 12 before the current display moment tc and a current display grayscale dc of the target display panel 12 at the current display moment tc are determined.

The monochrome pixel 120 of the target display panel 12 has an actual display brightness L2 at the current display moment tc. Previously, the monochrome pixel 120 of the target display panel 12 has an initial display brightness L1 at an initial display moment to. The target display panel 12 records the initial display brightness L1 of the monochrome pixel 120 at the initial display moment t0. The first display grayscale of the target display panel 12 before the current display moment includes a $1^{st}$ sub-display grayscale d1, a 2nd sub-display grayscale d2, and a $3^{rd}$ sub-display grayscale d3. The monochrome pixel 120 of the target display panel 12 sequentially passes a first display time period T1, a second display time period T2, and a third display time period T3 from the initial display moment t0 to the current display moment tc. The monochrome pixel 120 of the target display panel 12 has the $1^{st}$ sub-display grayscale d1 in the first display time period T1. The monochrome pixel 120 of the target display panel 12 has the 2nd sub-display grayscale d2 in the second display time period T2. The monochrome pixel 120 of the target display panel 12 has the $3^{rd}$ sub-display grayscale d3 in the third display time period T3. The $1^{st}$ sub-display grayscale d1, the 2nd sub-display grayscale d2, and the $3^{rd}$ sub-display grayscale d3 are different from one another. The $1^{st}$ sub-display grayscale d1, the 2nd sub-display grayscale d2, and the $3^{rd}$ sub-display grayscale d3 each are one of grayscales of 0 to 255. The target display panel 12 further determines that the monochrome pixel 120 of the target display panel 12 has the current display grayscale dc at the current display moment tc.

At step S152, a correspondence between the aging time of the target display panel 12 at the first display grayscale and the aging time of the target display panel 12 at the aging grayscale is determined.

The first display grayscale of the target display panel 12 before the current display moment includes the $1^{st}$ sub-display grayscale d1, the 2nd sub-display grayscale d2, and the $3^{rd}$ sub-display grayscale d3. The target display panel 12 determines that the $1^{st}$ sub-display grayscale d1 is the same as the $1^{st}$ aging grayscale $a_1$. An attenuation amount of a brightness of the monochrome pixel 120 of the target display panel 12 at the $1^{st}$ sub-display grayscale d1 in the first display time period T1 is equal to an attenuation amount of a brightness of the monochrome pixel 120 of the target display panel 12 at the $1^{st}$ aging grayscale $a_1$ after passing the first aging time period T1'. An attenuation amount of a brightness of the monochrome pixel 120 of the target display panel 12 at the 2nd sub-display grayscale d2 in the second display time period T2 is equal to an attenuation amount of a brightness of the monochrome pixel 120 of the target display panel 12 at the $1^{st}$ aging grayscale $a_1$ after passing the second aging time period T2'. An attenuation amount of a brightness of the monochrome pixel 120 of the target display panel 12 at the $3^{rd}$ sub-display grayscale d3 in the third display time period T3 is equal to an attenuation amount of a brightness of the monochrome pixel 120 of the target display panel 12 on the $1^{st}$ aging grayscale $a_1$ after passing the third aging time period T3'. The target display panel 12 obtains the first to third aging time periods T1' to T3' at the $1^{st}$ aging grayscale $a_1$ based on the first display time period T1, the second display time period T2, and the third display time period T3 at the $1^{st}$ to $3^{rd}$ sub-display grayscales. Then, the target display panel 12 obtains a sum TS of the aging time periods of the first to third aging time periods T1' to T3'. The sum of the first display time period T1, the second display time period T2, and the third display time period T3 at the $1^{st}$ to $3^{rd}$ sub-display grayscales of the target display panel 12 is equivalent to the aging time of the target display panel 12 at the first display grayscale. The sum TS of the aging time periods of the first to third aging time periods T1' to T3' of the target display panel 12 at the $1^{st}$ aging grayscale $a_1$ is equivalent to the aging time of the target display panel 12 at the aging grayscale. Therefore, the correspondence between the aging time of the target display panel 12 at the first display grayscale and the aging time of the target display panel 12 at the aging grayscale is determined.

At step S153, it is determined that the brightness-time characteristic of the monochrome pixel 120 of the target display panel 12 corresponds to the brightness-time characteristic of the monochrome pixel 110 of the test display panel 11 based on the correspondence of the aging time and the current display grayscale dc.

The target display panel 12 determines that the current display grayscale dc corresponds to one of the m test grayscales $b_1$ to $b_m$. Previously, the target display panel 12 determines that the aging time of the target display panel 12 at the first display grayscale corresponds to the sum TS of aging time periods TS of the first to third aging time periods T1' to T3' at the $1^{st}$ aging grayscale $a_1$. Therefore, the target display panel 12 determines that the brightness-time characteristic of the target display panel 12 corresponds to the brightness-time characteristic of the test display panel 11 at the test grayscale corresponding to the current display grayscale dc at the $1^{st}$ aging grayscale $a_1$ corresponding to the $1^{st}$ sub-display grayscale d1.

At step S154, an attenuation amount and a compensation amount of the brightness of the monochrome pixel 120 of the target display panel 12 at the current display moment tc are determined based on the brightness-time characteristic of the monochrome pixel 120 of the target display panel 12.

Previously, the target display panel 12 has determined that its brightness-time characteristic corresponds to the brightness-time characteristic of the test display panel 11 at the test grayscale corresponding to the current display grayscale dc at the $1^{st}$ aging grayscale $a_1$ corresponding to the $1^{st}$ sub-display grayscale d1. Thus, the target display panel 12 has obtained an attenuation amount of a brightness of the monochrome pixel 120 of the target display panel 12 after passing the sum TS of aging time periods from the initial display moment t0. The attenuation amount of the brightness of the monochrome pixel 120 of the target display panel 12 after passing the sum TS of aging time periods from the initial display moment t0 is equal to an attenuation amount of the brightness of the monochrome pixel 120 of the target display panel 12 from the initial display moment t0 to the current display moment tc. The target display panel 12 obtains the attenuation amount of the brightness of the monochrome pixel 120 of the target display panel 12 from the initial display moment t0 to the current display moment tc. The target display panel 12 compensates the attenuation amount of the brightness of the target display panel 12 from the initial display moment t0 to the current display moment tc. The attenuation amount of the brightness of the target display panel 12 from the initial display moment t0 to the current display moment tc is the attenuation amount of the brightness of the target display panel 12 at the current moment tc. The attenuation amount of the brightness of the target display panel 12 at the current moment tc is equal to the compensation amount of the brightness of the target display panel 12 at the current moment tc.

Here, a case in which the monochrome pixel 120 of the target display panel 12 sequentially passes the first display time period T1, the second display time period T2, and the third display time period T3 from the initial display moment t0 to the current display moment tc is only an example, and the same applies for a case in which the monochrome pixel 120 of the target display panel 12 sequentially passes more than three display time periods from the initial display moment t0 to the current display moment tc.

In this embodiment, the target display panel 12 determines the attenuation amount and compensation amount of the brightness of the monochrome pixel 120 of the target display panel 12 at the current display moment tc. The target display panel 12 compensates the attenuation amount of the brightness of the monochrome pixel 120 of the target display panel 12 at the current display moment tc. In this way, the target display panel 12 can avoid the attenuation of the actual display brightness of the monochrome pixel 120 of the target display panel 12 at the current display moment tc.

As shown in FIG. 15, the display brightness compensation method 1 further includes a following step.

After the attenuation amount and the compensation amount of the brightness of the monochrome pixel 120 of the target display panel 12 at the current display moment tc are determined based on the brightness-time characteristic of the monochrome pixel 120 of the target display panel 12, at step 155, a pixel voltage of the monochrome pixel 120 of the target display panel 12 at the current display moment tc is determined.

After compensation, the target display panel 12 adjusts the pixel voltage of the monochrome pixel 120 of the target display panel 12 at the current display moment tc based on the compensation amount of the brightness of the monochrome pixel 120 of the target display panel 12 at the current display moment tc. For example, the target display panel 12 is an organic light-emitting display panel. In the monochrome pixel 120 of the target display panel 12, a driving transistor has a structural parameter of K, a first power supply voltage of $V_{PVDD}$, a data voltage DATA of $V_{DATA}$, and a light-emitting driving current $I_D$ satisfying that: $I_D=K(V_{PVDD}-V_{DATA})$. The actual display brightness LD of the monochrome pixel 120 of the target display panel 12 is positively related to the light-emitting driving current $I_D$. The target display panel 12 adjusts a data voltage of the monochrome pixel 120 of the target display panel 12 at the current display moment tc based on the compensation amount of the brightness of the monochrome pixel 120 of the target display panel 12 at the current display moment. In this way, the target display panel 12 adjusts the actual display brightness L2 of the monochrome pixel 120 of the target display panel 12 at the current display moment tc. A ratio of the actual display brightness L2 of the monochrome pixel 120 of the target display panel 12 at the current display moment tc to the initial display brightness L1 of the monochrome pixel 120 of the target display panel 12 at the initial display moment t0 is greater than 0.99 and smaller than 1.01. Therefore, the display brightness of the monochrome pixel 120 of the target display panel 12 is the same or tends to be the same at different display moments.

As shown in FIG. 4 and FIG. 7, the monochrome pixel 110 is one of a red pixel, a green pixel, or a blue pixel.

The target display panel 12 respectively compensates the attenuation amount of the brightness of the red pixel, the green pixel, and the blue pixel of the target display panel 12 at the current display moment tc. After compensation, a ratio of the actual display brightness L2 of the red pixel of the target display panel 12 at the current display moment tc to the initial display brightness L1 of the red pixel of the target display panel 12 at the initial display moment t0 is greater than 0.99 and smaller than 1.01, a ratio of the actual display brightness L2 of the green pixel of the target display panel 12 at the current display moment tc to the initial display brightness L1 of the green pixel of the target display panel 12 at the initial display moment t0 is greater than 0.99 and smaller than 1.01, and a ratio of the actual display brightness L2 of the blue pixel of the target display panel 12 at the current display moment tc to the initial display brightness L1 of the blue pixel of the target display panel 12 at the initial display moment t0 is greater than 0.99 and smaller than 1.01. Therefore, the display brightness of the red pixel of the target display panel 12 is the same or tends to be the same at different display moments; the display brightness of the green pixel of the target display panel 12 is the same or tends to be the same at different display moments; and the display brightness of the blue pixel of the target display panel 12 is the same or tends to be the same at different display moments.

Figure 16:
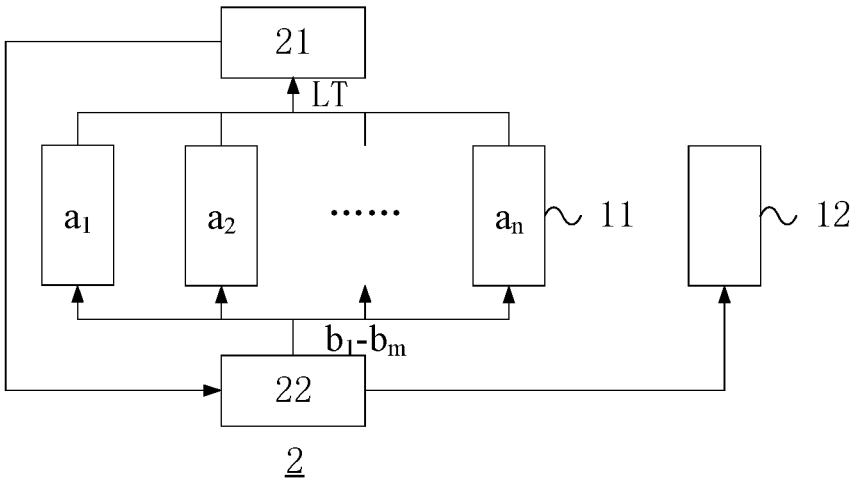
FIG. 16 is a schematic diagram of a structure of a display brightness compensation system according to an embodiment of the present disclosure.

FIG. 16 is a schematic diagram of a structure of a display brightness compensation system according to an embodiment of the present disclosure.

As shown in FIG. 16, a display brightness compensation system 2 includes n test display panels 11, a target display panel 12, an optical device 21, and a host computer 22. The n test display panels 11 set aging grayscales $a_1$ to $a_n$ for respective monochrome pixels 110. The host computer 22 sets the m test grayscales $b_1$ to $b_m$ for the monochrome pixel 110 of each test display panel 11. Each test display panel 11 illuminates respective aging grayscales of its monochromatic pixel 110 in a time period, and meanwhile, each test display panel 11 periodically illuminates each test grayscale for the monochrome pixel 110, and the optical device 21 periodically obtains the test display brightness LT of the monochrome pixel 110 of the test display panel 11 at the test grayscale at the aging grayscale. The host computer 22 calculates the brightness-time characteristic of the monochrome pixel 110 of the test display panel 11 at each test grayscale at each aging grayscale. The target display panel 12 compensates the actual display brightness L2 of the monochrome pixel 120 of the target display panel 12 at the current display moment tc based on the brightness-time characteristic. Here, both m and n are positive integers greater than or equal to 2. The monochrome pixels 110 of any two test display panels 11 have different aging grayscales.

In this embodiment, the display brightness compensation system 2 is configured to compensate the display brightness of the target display panel 12. The optical device 21 periodically obtains the test display brightness LT of the monochrome pixel 110 of the test display panel 11 at the test grayscale at the aging grayscale. The host computer 22 obtains the brightness-time characteristic of the monochrome pixel 110 of the test display panel 11 at each of the $1^{st}$ to $n^{th}$ aging grayscales $a_1$ to $a_n$ at each of the $1^{st}$ to $m^{th}$ test grayscales $b_1$ to $b_m$. The brightness-time characteristic of the monochrome pixel 110 of the test display panel 11 at each of the $1^{st}$ to $n^{th}$ aging grayscales $a_1$ to $a_n$ at each of the $1^{st}$ to $m^{th}$ test grayscales $b_1$ to $b_m$ is written into the target display panel 12. Thus, the target display panel 12 obtains the attenuation amount of the brightness of the monochrome pixel 120 of the target display panel 12 from the initial display moment t0 to the current display moment tc. The target display panel 12 compensates the attenuation amount of the brightness of the monochrome pixel 120 of the target display panel 12 from the initial display moment t0 to the current display moment tc. After compensation, the ratio of the actual display brightness L2 of the monochrome pixel 120 of the target display panel 12 at the current display moment tc to the initial display brightness L1 of the monochrome pixel 120 of the target display panel 12 at the initial display moment t0 is greater than 0.99 and smaller than 1.01. Therefore, the display brightness of the monochrome pixel 120 of the target display panel 12 is the same or tends to be the same at different display moments.

As shown in FIG. 16, the host computer 22 calculates the brightness-time characteristic of the monochrome pixel 110 of the test display panel 11 at each of the test grayscales of 0 to 255 at each of the aging grayscales of 0 to 255.

In this embodiment, the host computer 22 calculates the brightness-time characteristic of the monochrome pixel 110 of the test display panel 11 at each of the test grayscales of 0 to 255 at each of the aging grayscales of 0 to 255. The brightness-time characteristic of the monochrome pixel 110 of the test display panel 11 at each of the test grayscales of 0 to 255 at each of the aging grayscales of 0 to 255 includes data corresponding to full grayscales for the aging grayscale and the test grayscale. Thus, data on the brightness-time characteristic of the monochrome pixel 110 of the test display panel 11 at each of the test grayscales of 0 to 255 at each of the aging grayscales of 0 to 255 is more comprehensive. Therefore, the brightness-time characteristic of the monochrome pixel 110 of the test display panel 11 at each of the test grayscales of 0 to 255 at each of the aging grayscales of 0 to 255 has a better effect for display brightness compensation.

In summary, the present disclosure provides a display brightness compensation method and system, including: setting aging grayscales of monochrome pixels of n test display panels; setting m test grayscales of a monochrome pixel of each of then test display panels; during a time period, illuminating the aging grayscale of the monochrome pixel of each test display panel, periodically illuminating each test grayscale of the monochrome pixel of the test display panel, and periodically obtaining the test display brightness of the monochrome pixel of the test display panel at the test grayscale at the aging grayscale; calculating a brightness-time characteristic of the monochrome pixel of the test display panel at each test grayscale at each aging grayscale; and compensating an actual display brightness of the monochrome pixel of the target display panel at a current display moment based on the brightness-time characteristic. Here, both m and n are positive integers greater than or equal to 2, and the monochrome pixels of any two of the n test display panels have different aging grayscales. The display brightness of the monochrome pixel of the target display panel is the same or tends to be the same at different display moments.

What is claimed is:

1. A display brightness compensation method, comprising:

setting an aging grayscale of a monochrome pixel of each of n test display panels;

setting m test grayscales of the monochrome pixel of each of then test display panels;

during a time period, illuminating the aging grayscale of the monochrome pixel of each of the n test display panels, periodically illuminating each test grayscale of the m test grayscales of the monochrome pixel of each of then test display panels, and periodically obtaining a test display brightness of the monochrome pixel of each of then test display panels at the test grayscale at the aging grayscale;

calculating a brightness-time characteristic of the monochrome pixel of each of the n test display panels at each of the m test grayscales at the aging grayscale; and compensating an actual display brightness of a monochrome pixel of a target display panel at a current display moment based on the brightness-time characteristic, wherein both m and n are positive integers greater than or equal to 2, and the monochrome pixels of any two of then test display panels have different aging grayscales.

2. The display brightness compensation method according to claim 1, wherein said periodically obtaining the test display brightness of the monochrome pixel of each of the n test display panels at the test grayscale at the aging grayscale comprises:

obtaining the test display brightness of the monochrome pixel of each of $1^{st}$ to $(n-1)^{th}$ test display panels of the n test display panels at an $m^{th}$ test grayscale of the m test grayscales at respective aging grayscale in each period; and obtaining the test pixel brightness of the monochrome pixel of an $n^{th}$ test display panel of then test display panels at each of $1^{st}$ to $m^{th}$ test grayscales of the m test grayscales at the aging grayscale in each period.

3. The display brightness compensation method according to claim 2, wherein said calculating the brightness-time characteristic of the monochrome pixel of each of the n test display panels at each of the m test grayscales at the aging grayscale comprises:

calculating the brightness-time characteristic of the monochrome pixel of each of the $1^{st}$ to $n^{th}$ test display panels at the $m^{th}$ test grayscale at respective aging grayscale based on the test display brightness; and calculating the brightness-time characteristic of the monochrome pixel of the $n^{th}$ test display panel at each of the $1^{st}$ to $m^{th}$ test grayscales at the aging grayscale based on the test display brightness.

4. The display brightness compensation method according to claim 3, further comprising:

after said calculating the brightness-time characteristic of the monochrome pixel of each of the $1^{st}$ to $n^{th}$ test display panels at the $m^{th}$ test grayscale at respective aging grayscale based on the test display brightness, determining a correspondence between test aging time of the monochrome pixel of each of the $1^{st}$ to $(n-1)^{th}$ test display panels at respective aging grayscale and test aging time of the monochrome pixel of the $n^{th}$ test display panel at the aging grayscale; and after said calculating the brightness-time characteristic of the monochrome pixel of the $n^{th}$ test display panel at each of the $1^{st}$ to $m^{th}$ test grayscales at the aging grayscale based on the test display brightness, determining a brightness-time characteristic of the monochrome pixel of each of the $1^{st}$ to $(n-1)^{th}$ test display panels at each of the $1^{st}$ to $(m-1)^{th}$ test grayscales based on the correspondence.

5. The display brightness compensation method according to claim 3, wherein n is an integer smaller than 256.

6. The display brightness compensation method according to claim 5, further comprising, after said calculating the brightness-time characteristic of the monochrome pixel of each of the $1^{st}$ to $n^{th}$ test display panels at the $m^{th}$ test grayscale at respective aging grayscale based on the test display brightness: determining a brightness-time characteristic at each of aging grayscales of 0 to 255 based on the brightness-time characteristic of the monochrome pixel of the test display panel at each of the $1^{st}$ to $n^{th}$ aging grayscales.

7. The display brightness compensation method according to claim 3, wherein m is an integer smaller than 256.

8. The display brightness compensation method according to claim 7, further comprising, after said calculating the brightness-time characteristic of the monochrome pixel of the $n^{th}$ test display panel at each of the $1^{st}$ to $m^{th}$ test grayscales at the aging grayscale based on the test display brightness: determining a brightness-time characteristic at each of test grayscales of 0 to 255 based on the brightness-time characteristic of the monochrome pixel of the test display panel at each of the $1^{st}$ to $m^{th}$ test grayscales.

9. The display brightness compensation method according to claim 1, wherein said calculating the brightness-time characteristic of the monochrome pixel of each of the n test display panels at each of the m test grayscales at the aging grayscale comprises: calculating the brightness-time characteristic of the monochrome pixel of the test display panel at each of test grayscales of 0 to 255 at each of aging grayscales of 0 to 255.

10. The display brightness compensation method according to claim 9, further comprising, after said calculating the brightness-time characteristic of the monochrome pixel of the test display panel at each of test grayscales of 0 to 255 at each of aging grayscales of 0 to 255: storing the brightness-time characteristic of the monochrome pixel of the test display panel at each of test grayscales of 0 to 255 at each of aging grayscales of 0 to 255.

11. The display brightness compensation method according to claim 10, wherein said compensating the actual display brightness of the monochrome pixel of the target display panel at the current display moment based on the brightness-time characteristic comprises:

determining a first display grayscale of the target display panel before the current display moment and a current display grayscale of the target display panel at the current display moment;

determining a correspondence between aging time of the target display panel at the first display grayscale and aging time of the target display panel at a $n^{th}$ aging grayscale;

determining that a brightness-time characteristic of the monochrome pixel of the target display panel corresponds to the brightness-time characteristic of the monochrome pixel of one of then test display panels based on the correspondence and the current display grayscale; and determining an attenuation amount and a compensation amount of a brightness of the monochrome pixel of the target display panel at the current display moment based on the brightness-time characteristic of the monochrome pixel of the target display panel.

12. The display brightness compensation method according to claim 11, further comprising, after said determining that the attenuation amount and the compensation amount of the brightness of the monochrome pixel of the target display panel at the current display moment based on the brightness-time characteristic of the monochrome pixel of the target display panel: adjusting a pixel voltage of the monochrome pixel of the target display panel at the current display moment.

13. The display brightness compensation method according to claim 1, wherein the monochrome pixel is one of a red pixel, a green pixel, or a blue pixel.

14. A display brightness compensation system, comprising:

n test display panels;

a target display panel;

an optical device; and a host computer, wherein each test display panel of the n test display panels is configured to set an aging grayscale of a monochrome pixel of the test display panel;

the host computer is configured to set m test grayscales of the monochrome pixel of each of the n test display panels;

each test display panel of the n test display panels is configured to illuminate the aging grayscale of the monochromatic pixel during a time period, and to periodically illuminate each test grayscale of the m test grayscales of the monochrome pixel of each of then test display panels, and the optical device is configured to periodically obtain a test display brightness of the monochrome pixel of each of then test display panels at the test grayscale at the aging grayscale;

the host computer is configured to calculate a brightness-time characteristic of the monochrome pixel of each of the n test display panels at each of the m test grayscales at the aging grayscale; and the target display panel is configured to compensate an actual display brightness of a monochrome pixel of the target display panel at a current display moment based on the brightness-time characteristic, wherein both m and n are positive integers greater than or equal to 2, and the monochrome pixels of any two of the n test display panels have different aging grayscales.

15. The display brightness compensation system according to claim 14, wherein the host computer is configured to calculate the brightness-time characteristic of the monochrome pixel of each of the n test display panels at each of test grayscales of 0 to 255 at each of aging grayscales of 0 to 255.

* * * * *